US006524192B1

(12) United States Patent
Tsujita et al.

(10) Patent No.: US 6,524,192 B1
(45) Date of Patent: Feb. 25, 2003

(54) BOWLING PIN ARRANGEMENT CONTROL DEVICE AND ITS CONNECTING UNIT

(75) Inventors: Masahiro Tsujita, Osaka (JP); Yoshitaka Yamauchi, Osaka (JP)

(73) Assignee: Telesystems Co., Ltd., Osaka (JP)

( * ) Notice: Subject to any disclaimer, the term of this patent is extended or adjusted under 35 U.S.C. 154(b) by 0 days.

(21) Appl. No.: 09/601,042

(22) PCT Filed: Aug. 9, 1999

(86) PCT No.: PCT/JP99/04313

§ 371 (c)(1),
(2), (4) Date: Jul. 26, 2000

(87) PCT Pub. No.: WO00/35544

PCT Pub. Date: Jun. 22, 2000

(30) Foreign Application Priority Data

Dec. 11, 1998 (JP) ..... 10-352745
Mar. 2, 1999 (JP) ..... 10-053629

(51) Int. Cl.[7] ..... A63D 5/08

(52) U.S. Cl. ..... 473/73; 473/57; 473/86; 473/87

(58) Field of Search ..... 473/54, 57, 65, 473/86, 87, 88, 89, 92

(56) References Cited

U.S. PATENT DOCUMENTS 3,138,378 A * 6/1964 Krollman
3,265,390 A * 8/1966 Stauth
3,314,678 A * 4/1967 Conklin
5,393,269 A * 2/1995 Atkinson

FOREIGN PATENT DOCUMENTS

JP 607879 1/1985
JP 63288175 11/1988

* cited by examiner

*Primary Examiner*—William M. Pierce
(74) *Attorney, Agent, or Firm*—Pillsbury Winthrop LLP

(57) ABSTRACT

A pin arrangement control apparatus, as well as a system therefor, capable of pin arrangement in any arbitrary pin arrangement patterns are implemented only by slightly modifying a pin setter machine equipped with only basic functions for performing the so-called tenpin bowling.

A common pin setter machine equipped with means for setting the first-bowl ten pins, and means for gripping and elevating the set pins, sweeping with the rake and then rearranging the pins is additionally equipped with a selective pin gripping mechanism for gripping only pins corresponding to a pin arrangement pattern given from external. Thus, the pin setter machine is capable of pin arrangement in a specified pin arrangement pattern for rearrangement of the second-bowl pins.

6 Claims, 24 Drawing Sheets

BOWLING PIN ARRANGEMENT CONTROL DEVICE AND ITS CONNECTING UNIT

BACKGROUND OF THE INVENTION

The present invention relates to an apparatus for controlling the pin arrangement for bowling and a connecting unit to be used in the apparatus.

DESCRIPTION OF THE PRIOR ART

In conventionally common bowling alleys, there are provided a pin setter machine for setting pins to a pin arrangement position in a rear end portion of a lane, and an automatic bowling scoring unit for performing scoring process of bowling by detecting a pin state after a bowl.

The pin setter machine has a function for newly arranging ten pins as first-bowl pins to a pin arrangement position in the rear end portion of the lane (first-bowl pin setting means), and a function for, upon detection of a bowl, gripping and elevating pins standing erect in the pin arrangement position, making a sweep over remaining pins and fallen pins with a mechanism for removing those pins (hereinafter, referred to as "rake"), and thereafter rearranging the elevated pins (second-bowl pin setting means).

Such a conventionally common pin setter machine merely has the basic functions of setting ten pins erect for the first bowl and rearranging remaining pins for the second bowl, which would come after anon-strike. Therefore, the pin setter machine has been capable of no more than basic bowling games.

In contrast to this, there has also been developed, and in use, a pin setter machine which allows pin arrangement to be performed in specified arbitrary pin patterns in order that a higher degree of freedom of pin arrangement and, as a result, a wider variety of bowling games are enabled.

If pin arrangement in arbitrary pin patterns is enabled like this, it becomes possible, for example, to exercise bowling practice by aiming at spares quite efficiently. It also becomes feasible to perform novel bowling games with changed variations of pin arrangement pattern other than the so-called tenpin bowling.

The conventional pin setter machine that has enabled arbitrary setting of pin arrangement patterns comprises a pin elevator for carrying fallen, swept-up pins up to a specified height, a pin shooter for carrying the pins up to a specified position, a distributor for supplying the pins to a specified position in a pin setting table, and the like. However, the distributor for supplying the pins to any arbitrary position in the pin setting table is large scaled, complex and large in general construction, and expensive by machine itself.

Meanwhile, for bowling alleys in which pin setter machines incapable of pin arrangement in such arbitrary pin arrangement patterns are provided, it has been substantially unreasonable to abandon their existing pin setter machines and substitute therefor the aforementioned pin setter machines capable of setting arbitrary pin arrangement patterns, in terms of time and cost required for the dismantling and reinstallation. Still, the traditional pin setter machines having only the basic functions for tenpin bowling are strong machines which are operated in major part by mechanical control, and therefore will not break early and, even if worn, can be continuously used by replacing only its component parts for the worn parts. Thus, the replacement with new machines has been made even more difficult.

An object of the present invention is to provide a pin arrangement control apparatus, as well as a connecting unit to be used in the apparatus, which is capable of pin arrangement in arbitrary pin arrangement patterns, without substituting a new pin setter machine for a pin setter machine provided with only basic functions of performing the so-called tenpin bowling.

SUMMARY OF THE INVENTION

The pin arrangement control apparatus of the present invention comprises: scissors for pinching a neck portion of a bowling pin; a link mechanism for performing opening/closing operation of the scissors; and a connecting unit provided between the scissors and the link mechanism, wherein the connecting unit comprises: a solenoid which is set electrically selectively to conducting or non-conducting state; and a lock mechanism for setting the scissors and the link mechanism into a linked state or a free state therebetween in response to an operating state of the solenoid.

Also, the connecting unit for pin arrangement control in bowling of the present invention, comprises: a solenoid which is provided between scissors for pinching a neck portion of a bowling pin and a link mechanism for performing opening/closing operation of the scissors and which is set electrically selectively to conducting or non-conducting state; and a lock mechanism for setting the scissors and the link mechanism into a linked state or a free state therebetween in response to an operating state of the solenoid.

With the above constitution, which ones of the ten pins should be set can be set by selecting conduction or non-conduction of the solenoid. As a result, for example, it becomes possible to set a bowling practice mode in any arbitrary pin arrangement patterns, so that spare practice is facilitated. Still, there is no need of any complex mechanism, and all that is needed is to provide a connecting unit in which a solenoid is provided at a connecting portion between the scissors and the link mechanism. Therefore, the pin setter machine can be put into use as a machine which allows pin arrangement to be implemented in any arbitrary pin arrangement patterns, without entirely replacing the pin setter machine by a new pin setter machine equipped with a distributor for feeding pins to any arbitrary positions of a pin setting table.

Also, the lock mechanism of the pin arrangement control apparatus according to the present invention comprises: a pipe which is provided opposite to a groove formed along a rod perimeter of the link mechanism and which is attached to the scissors so as to cover the rod perimeter; and a plurality of balls held by the pipe, wherein the pipe and the rod are put into a latched state or a non-latched state by making the balls fitted or non-fitted to the groove depending on actuation of the solenoid.

Also, the lock mechanism of the connecting unit for pin arrangement control in bowling according to the present invention comprises: a pipe which is provided opposite to a groove formed along a rod perimeter of the link mechanism and which is attached to the scissors so as to cover the rod perimeter; and a plurality of balls held by the pipe, wherein the pipe and the rod are put into a latched state or a non-latched state by making the balls fitted or non-fitted to the groove depending on actuation of the solenoid.

Further, as another embodiment, the lock mechanism comprises: a slide member which is attached to the link mechanism and which is put into a slide-locked state or a free-slide state depending on whether or not the slide member makes contact with the actuation portion of the solenoid depending on non-conduction or conduction of the solenoid; and a transform mechanism for transforming a straight motion of the pin into a rotational motion of the scissors, wherein the scissors and the link mechanism are put into a linked state or a free state therebetween by putting the slide member into the free-slide state or the slide-locked state depending on actuation of the solenoid.

Further, as yet another embodiment, the lock mechanism comprises: a transform mechanism which has an elongate hole capable of insertion of the pin provided in the link mechanism and which transforms a straight motion into a rotational motion and then giving the resultant motion to the scissors; and a pin coupling plate for putting the pin, which has been inserted in the elongate hole, into a coupled state or a non-coupled state with the elongate hole depending on non-conduction or conduction of the solenoid, wherein the scissors and the link mechanism are put into a linked state or a free state therebetween by putting the pin into the coupled state or the de-coupled state depending on actuation of the solenoid.

With the above mechanism, the lock mechanism can be easily provided without the need for largely modifying already installed link mechanism and scissors. Therefore, the mechanism can be incorporated into the existing pin setter machine in a short time period and with low cost.

Also, the pin arrangement control apparatus for bowling according to the present invention further comprises: pin arrangement pattern setting means for setting an arbitrary pin arrangement pattern; and means for setting the non-conducting state or the conducting state of the solenoid in response to a set pin arrangement pattern.

With this constitution, the bowler is allowed to set any arbitrary pin arrangement patterns, thus enabled to easily exercise a variety of spare practices.

Also, in the pin arrangement control apparatus for bowling according to the present invention, the pin arrangement pattern setting means is a means for inputting a pin arrangement pattern on screen. As a result, any pin arrangement pattern can be easily set on the screen.

Also, in the pin arrangement control apparatus for bowling according to the present invention, the pin arrangement pattern setting means is a means for selecting a pin arrangement pattern from among previously stored pin arrangement patterns. As a result, for example, a desired pin arrangement pattern for challenge can be easily set only by selecting the pin arrangement pattern from among typical pin arrangement patterns for spare practice.

Also, the pin arrangement control apparatus for bowling according to the present invention further comprises: means for receiving input of a medium such as a coin or a value-stored card; and means for enabling input of the pin arrangement pattern upon input of the medium.

With this constitution, bowling practice or the like can be easily charged for payment.

DETAILED DESCRIPTION OF THE PREFERRED EMBODIMENTS

The constitution of mechanical part of the pin arrangement control apparatus for bowling according to an embodiment of the present invention is described with reference to FIGS. 1 to 6.

Figure 1:
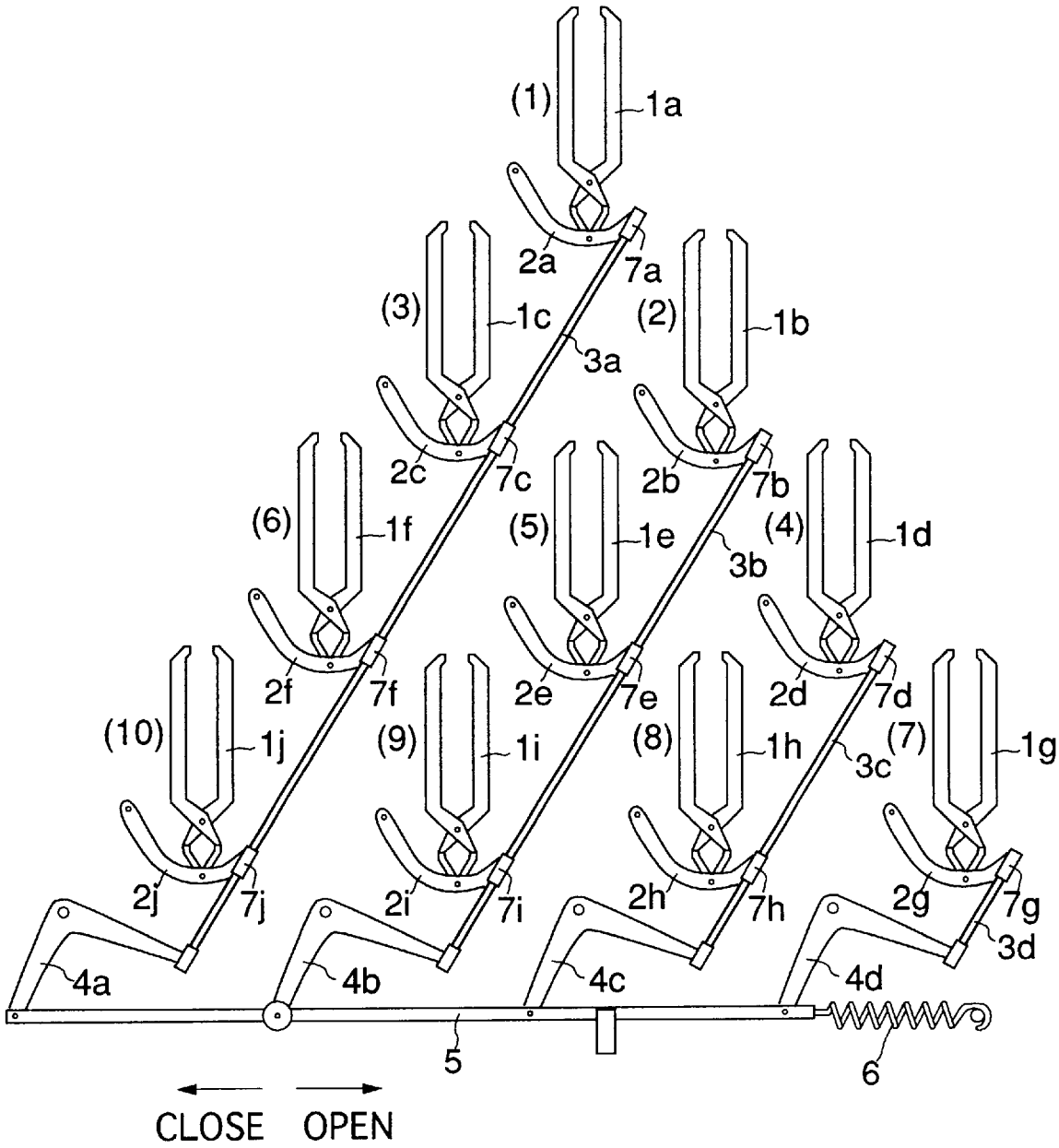
FIG. 1 is a view showing the constitution of a pin gripping mechanism.

FIG. 1 is a view showing the pin gripping mechanism portion provided together with pin holders for holding pins to be newly arranged. Pin setter machines which have been installed in bowling alleys, in many cases, have generally the same mechanism as shown in FIG. 1, whereas in the apparatus of FIG. 1, connecting units 7*a*–7*j* are units of novel structure shown in FIG. 2. As will be described later, these novel-structured units can be easily set up in a state in which the whole equipment has already been installed. These connecting units 7*a*–7*j* are capable of setting a linked state and a released state (free state) of rods 3*a*–3*d* and pivoting members 2*a*–2*j* by electrical signals as will be described later.

Referring to FIG. 1, reference numerals 1*a*–1*j* denote scissors which pinch erectly standing pin necks of the first to tenth pins, and which are connected to the pivoting members 2*a*–2*j*, respectively. These pivoting members 2*a*–2*j* pivot about one-side ends (left-side ends in the figure), and the other-side ends are connected to the rods 3*a*, 3*b*, 3*c*, 3*d* at the connecting units 7*a*–7*j*, respectively. Also, these rods 3*a*, 3*b*, 3*c*, 3*d* have their one-side ends connected to one-side ends of the pivoting members 4*a*, 4*d*, 4*c*, 4*d*, respectively. The other-side ends of the pivoting members 4*a*, 4*d*, 4*c*, 4*d* are connected to a rod 5. These pivoting members 4*a*, 4*d*, 4*c*, 4*d* pivot about their nearly center portions. Therefore, by moving the rod 5 in its axial direction (right-and-left direction in the figure), the pivoting members 4*a*, 4*d*, 4*c*, 4*d* are pivoted, causing the rods 3*a*–3*d* to move in their axial directions. Now assuming that all the connecting units 7*a*–7*j* are set to the linked state, by the rods 3*a*–3*d* moving axially, the pivoting members 2*a*–2*j* connected to the rods are pivoted, so that the scissors 1*a*–1*j* are opened or closed, respectively. In more detail, the scissors 1*a*–1*j* are all opened by moving the rod 5 to a specified extent rightward in the figure, and the scissors 1*a*–1*j* are all closed by moving the rod 5 leftward in the figure. Since a spring 6, which is a tension spring, is attached at one end of the rod 5, the rod 5 is taken up rightward in the figure, so that the scissors 1*a*–1*j* are normally held in the opened state.

The connecting units 7*a*–7*j* can be switched over from the linked state to the free state, individually. Also, the connecting units 7*a*–7*j* can be switched over from the free state to the linked state as well. In the free state, even if the rods 3*a*–3*d* move, the scissors 1*a*–1*j* are not operated, neither opened nor closed. This switching of state of the connecting units can be made by selecting conduction and non-conduction to a solenoid contained in each of the units.

With this arrangement, by giving an electrical signal selectively to the connecting units 7*a*–7*j*, the opening/closing control of the scissors 1*a*–1*j* by the move of the rod 5 can be selectively exerted.

Figure 2:
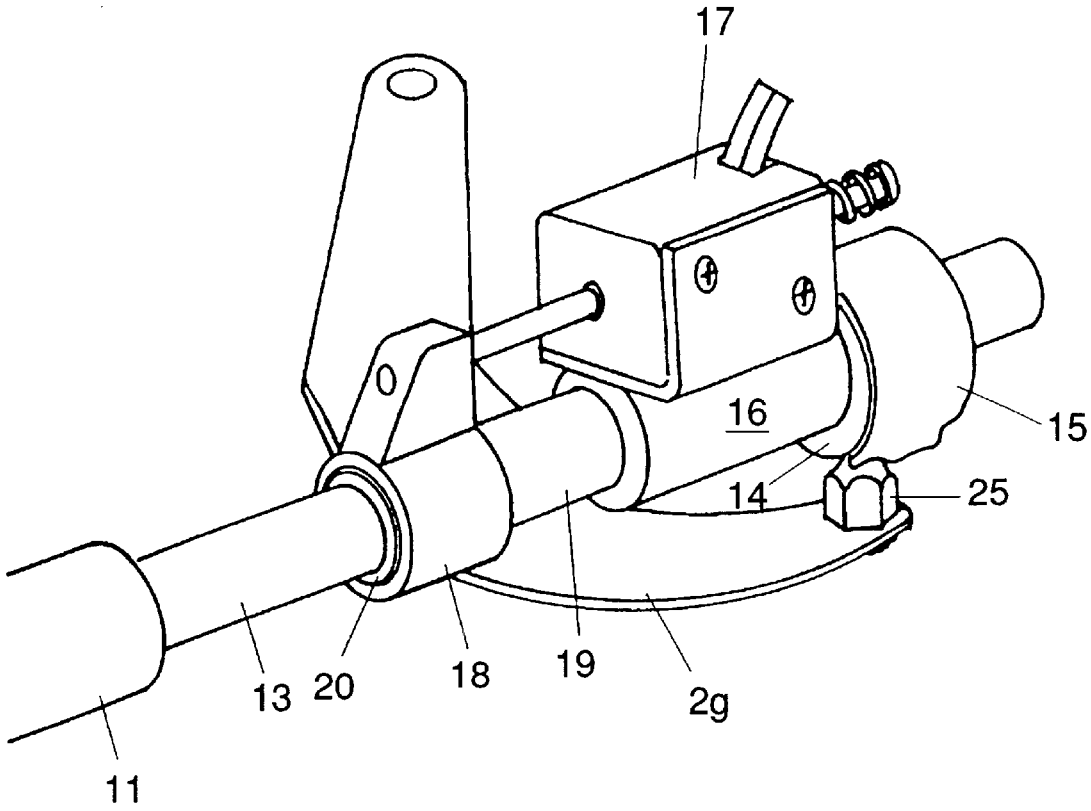
FIG. 2 is a view showing the constitution of the rod and the connecting unit of the same mechanism.
Figure 3:
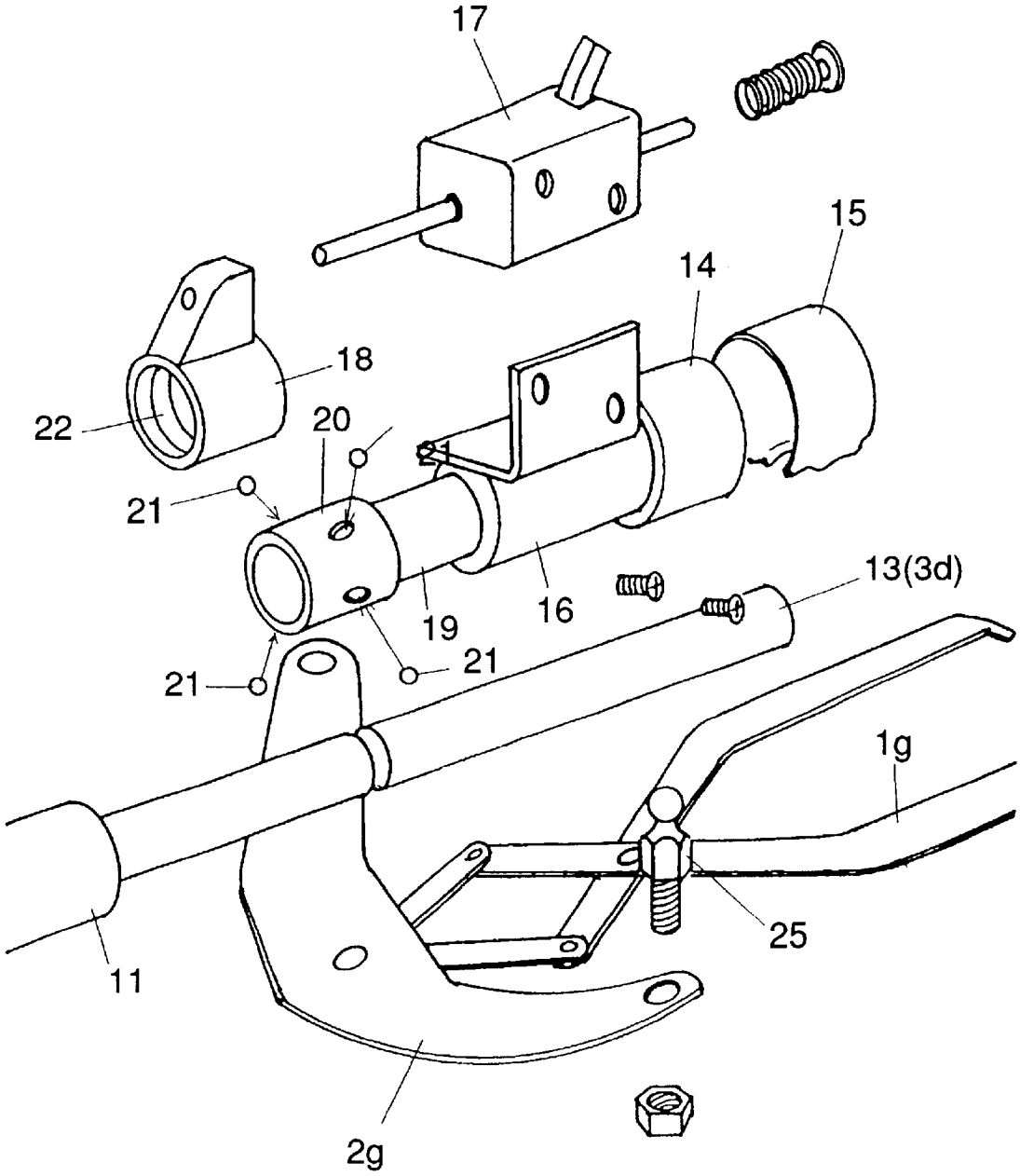
FIG. 3 is an exploded perspective view of the same part.

FIG. 2 is a perspective view, in an assembled state, of the connecting part (connecting unit 7*g*) between the rod 3*d* and the pivoting member 2*g* shown in FIG. 1, and FIG. 3 is an exploded perspective view thereof. Referring to FIGS. 2 and 3, reference numeral 13 denotes a link rod and 11 denotes a rod holding portion therefor. Numeral 19 denotes a pipe which allows the link rod 13 to be passed therethrough, and a ball-latch inner circumferential portion 20 is provided at a specified site of this pipe. Numeral 18 denotes a ball-latch outer circumferential portion of the pipe, where a ball-latch portion is formed by inserting a plurality of balls 21 into holes formed in the ball-latch inner circumferential portion 20 and by attaching the ball-latch outer circumferential portion 18 thereon. This ball-latch part is placed so as to be opposed to a groove formed in the link rod 13 as will be described later. A mechanical portion that switches between linked state and free state by these balls is herein referred to as "ball-latch". Numeral 17 denotes a solenoid which drives the ball-latch outer circumferential portion 18 in the axial direction, and which is secured to the pipe 19 via a solenoid holding portion 16. Further, 14 denotes a pipe holding portion, and a shell cap 15 is attached to the pipe holding portion 14. A link stud 25 connected to one end of the pivoting member 2*g* is inserted into a hole of the pipe holding portion 14.

Figure 4A:
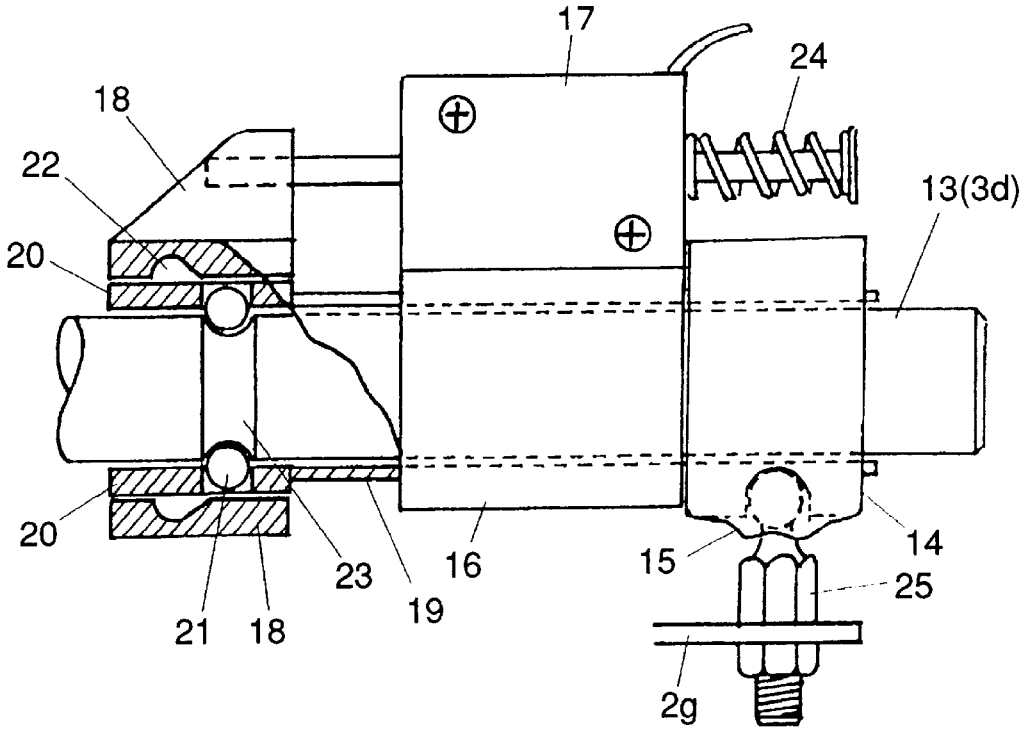
FIGS. 4A and 4B are views showing operational states of the same part.
Figure 4B:
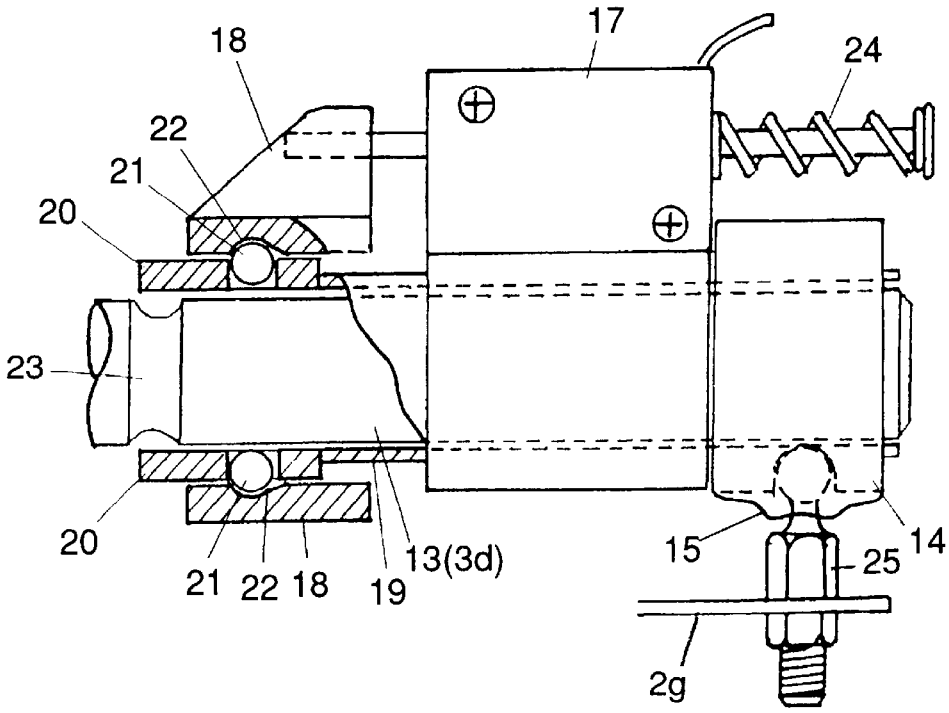

FIGS. 4A and 4B are partly broken views showing the function of the ball-latch part. Referring to FIGS. 4A and 4B, reference numeral 24 denotes a return spring for returning the solenoid 17. With the solenoid 17 non-conducting, the return spring 24 displaces the ball-latch outer circumferential portion 18 leftward in the figure as shown in FIG. 4A. With the solenoid 17 conducting, as shown in FIG. 4B, the return spring 24 displaces the ball-latch outer circumferential portion 18 rightward in the figure. Depending on the state of this solenoid, the connecting unit performs different operations as state below:

With solenoid non-conducting:

Numeral 22 denotes a groove formed in the inner surface of the ball-latch outer circumferential portion 18, and 23 denotes a groove formed around the link rod 13. FIG. 4A shows a state in which a ball 21 has been fitted into the groove 23. Since this ball 21 is accommodated within the hole formed in the ball-latch inner circumferential portion 20, the groove 23 of the link rod 13 and the ball-latch inner circumferential portion 20 are, in the state of 4A, are latched via the ball 21. The ball-latch inner circumferential portion 20 is integrated with the pipe holding portion 14 via the pipe 19 as shown in FIGS. 2 and 3. Therefore, as a result, the pivoting member 2*g* shown in FIG. 1 is displaced in linkage with the link mechanism.

With solenoid conducting:

With the solenoid 17 conducting, as shown in FIG. 4B, when the ball-latch outer circumferential portion 18 is displaced rightward in the figure, the ball 21 is enabled to move to the groove 22 of the inner circumferential surface of the ball-latch outer circumferential portion 18. Then, as the link rod 13 is displaced leftward in the figure, the ball 21 is released from the groove 23 of the link rod 13. Therefore, in this state, the pipe 19 is freed from the link rod 13.

Although the rod 3*d* for the seventh pin in FIG. 1 has been shown as the example shown in FIGS. 2 to 4, the connecting units comprising the pipe 19, the ball latches (18, 20, 21), the solenoid 17, the solenoid holding portion 16, the pipe holding portion 14 and the shell cap 15 are provided likewise at movable ends of the pivoting members 2*a*–2*f*, 2*h*–2*j*.

Whereas the conventional pin gripping mechanism has been such that the link stud 25 is connected to the link rod 13 with an appropriate member attached thereto, the above-mentioned connecting unit is substituted therefor, by which a selective pin gripping mechanism is constituted.

Figure 24:
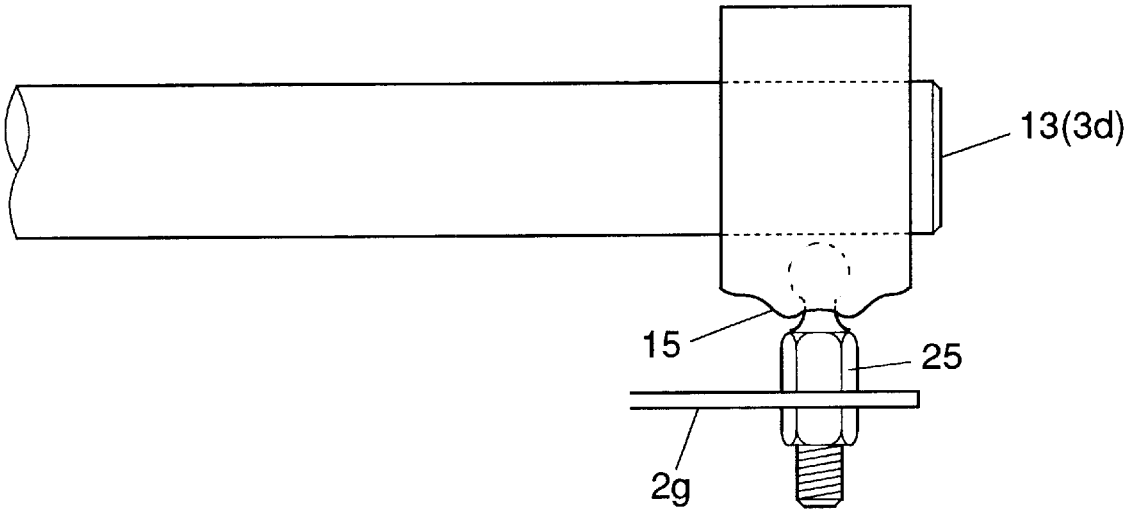
FIG. 24 is a view showing part of a pin gripping mechanism of general use.

FIG. 24 shows an example of the conventional pin gripping mechanism in which the link stud 25 is connected to the link rod 13. This is an example of the structures used in equipment that has already been installed in bowling alleys, in which example a pin-like link stud 25 is merely connected to the link rod 13 in a linked state. In some cases, the pin gripping mechanism having such a structure as shown in FIG. 24 is not necessarily adopted for all the ten pins for various reasons. However, generally, connecting structures of the link rod 13 and the link stud 25 as shown in FIG. 24 are provided in correspondence to the ten pins, or pins of a number close to ten. Therefore, by removing the member for this connection, a selective pin gripping mechanism can be made up simply by attaching the connecting unit.

Figure 5:
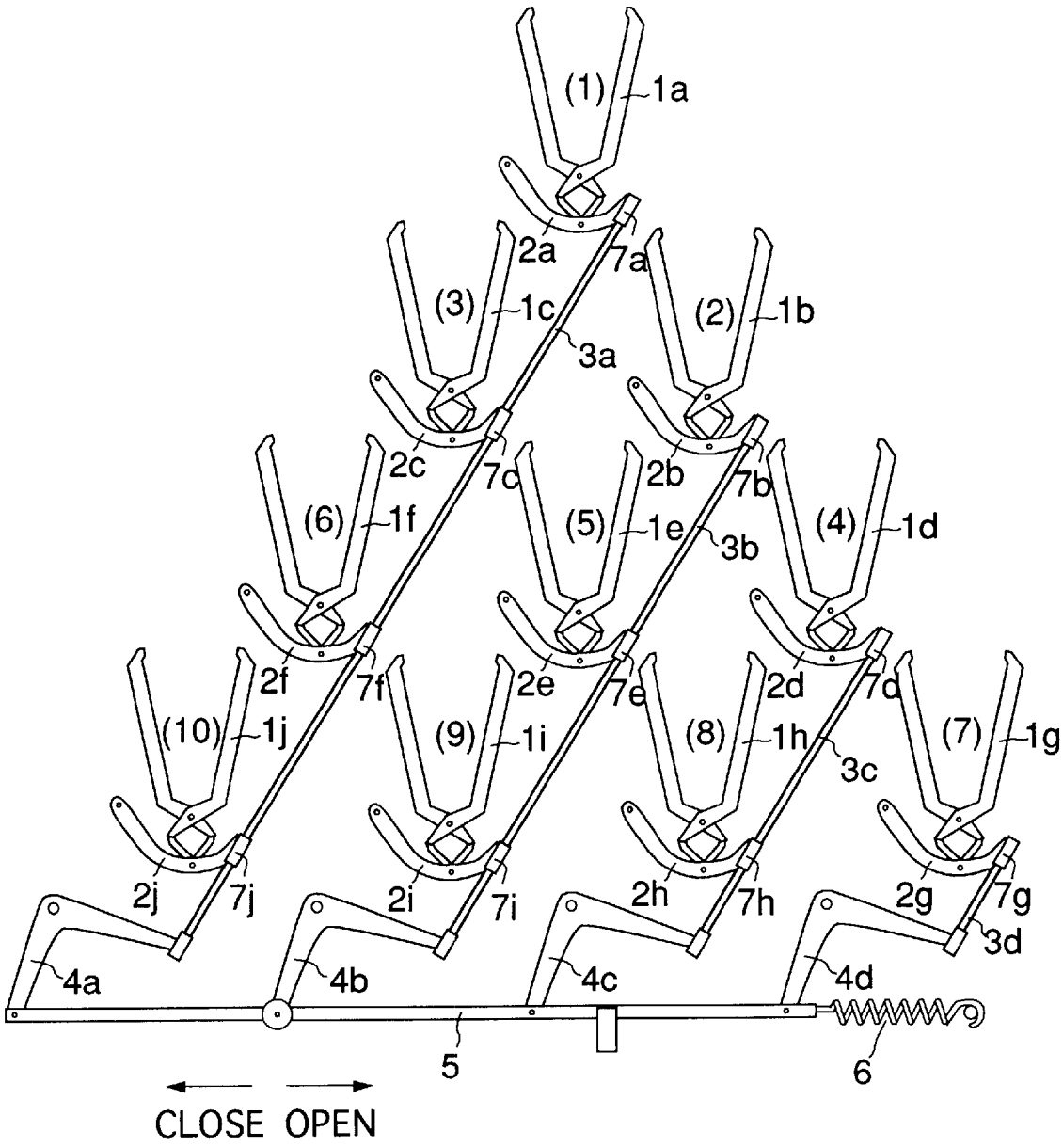
FIG. 5 is a view showing an operational state of a pin gripping mechanism.
Figure 6:
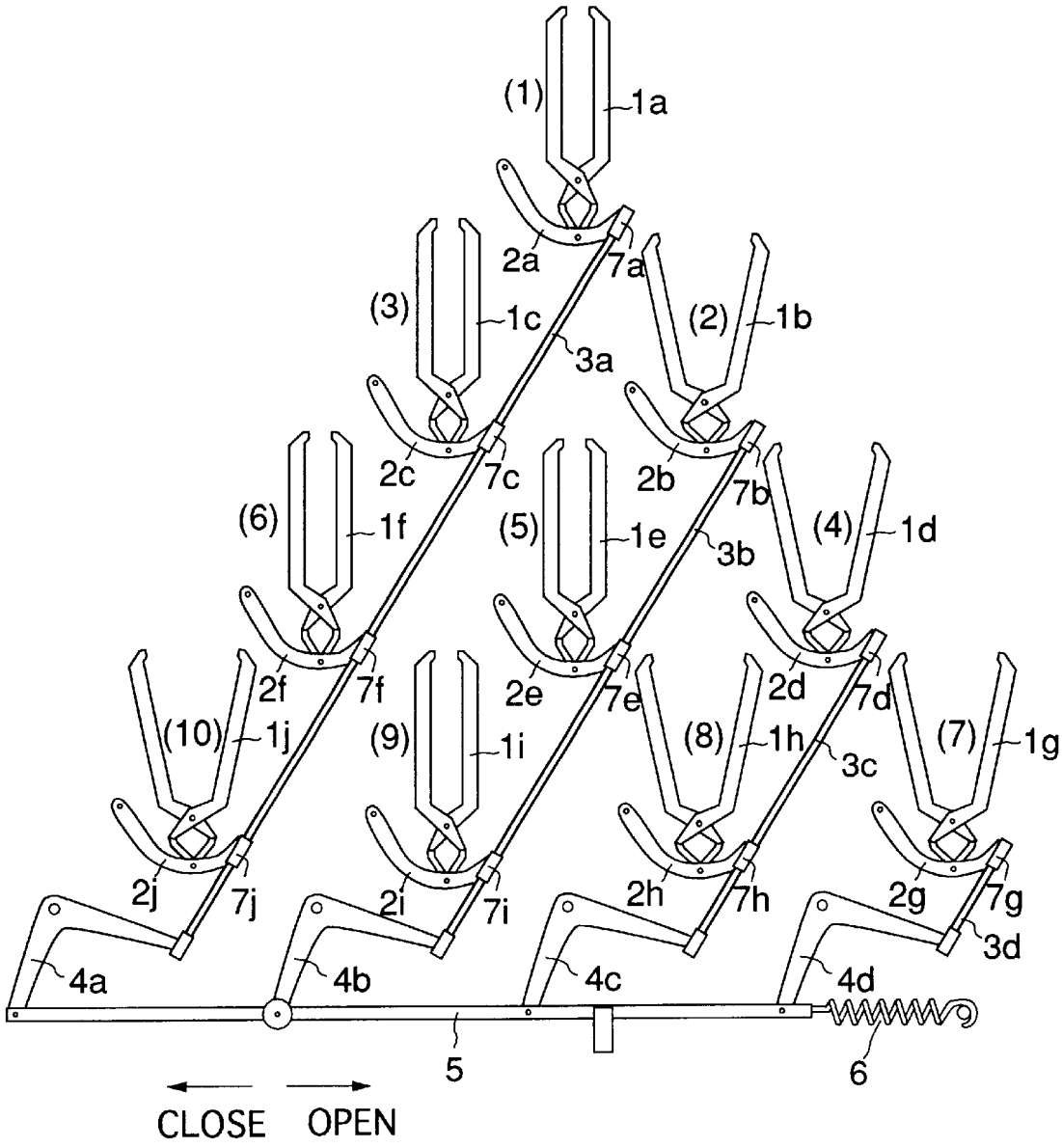
FIG. 6 is a view showing an operational state of the pin gripping mechanism.

With the selective pin gripping mechanism as shown above, for gripping and rearranging any arbitrary pins from a state that all the pins (ten pins) are set, to a state that none of the solenoids are conducting (i.e., a linked state shown in FIG. 4A), the rod 5 is first moved toward the open position as shown in FIG. 5, causing all the scissors to open, and the pin holders are lowered until the scissors come to heights of the neck portions of the erect pins. After that, for example, if a pin arrangement with the 2nd, 4th, 7th, 8th and 10th pins excluded is desired, the rod 5 is moved toward the closing side with the solenoids for those pins conducting (i.e., a free state shown in FIG. 4B). As a result, as shown in FIG. 6, the scissors for the 2nd, 4th, 7th, 8th and 10th pins are maintained opened, and only the scissors for the 1st, 3rd, 5th, 6th and 9th pins to be set are closed. After that, the pin holders are elevated and the remaining erect pins (2nd, 4th, 7th, 8th and 10th pins) are swept by the rake, and then the pin holders are lowered so that the rod 5 is moved to the open side. In this process, the free scissors corresponding to the 2nd, 4th, 7th, 8th and 10th pins are maintained opened irrespectively of the move of the rod 5, whereas the linking scissors corresponding to the 1st, 3rd, 5th, 6th and 9th pins are opened along with the move of the rod. Thus, all the scissors are opened and the pin holders are elevated again, by which the targeted 1st, 3rd, 5th, 6th and 9th pins can be set.

In addition, the solenoids corresponding to the 2nd, 4th, 7th, 8th and 10th pins are in the conducting state at this stage. Therefore, when the scissors are opened after setting the 1st, 3rd, 5th, 6th and 9th pins (by moving the rod 5 toward the open side), the electrical conduction to the 2nd, 4th, 7th, 8th and 10th pins is halted. At this time point, the link rod 13 is moved toward the scissor-open position (rightward in FIG. 4) so that the groove 23 is in the position of the ball 21. Therefore, when force of the return spring 24 for the solenoid 17 is applied so as to push the ball-latch outer circumferential portion 18 leftward in the figure, the ball 21 is fitted into the groove 23 and, simultaneously, the ball-latch outer circumferential portion 18 is displaced leftward in FIG. 4, returning to the linked state shown in FIG. 4A. In addition, the conduction to the solenoid may be halted before the scissors are opened. In this case, referring to FIG. 4, the force of the return spring 24 for the solenoid 17 is first applied so as to push the ball-latch outer circumferential portion 18 leftward in the figure. After that, by the rod 5 moving toward the open side, the link rod 13 is moved toward the scissor-opened position (rightward in FIG. 4). Therefore, at the time when the groove 23 has moved to the position of the ball 21, the ball 21 is fitted into the groove 23 and, simultaneously, the ball-latch outer circumferential portion 18 is displaced leftward in FIG. 4 by the pressing force of the return spring 24, returning to the linked state shown in FIG. 4A.

Figure 7A:
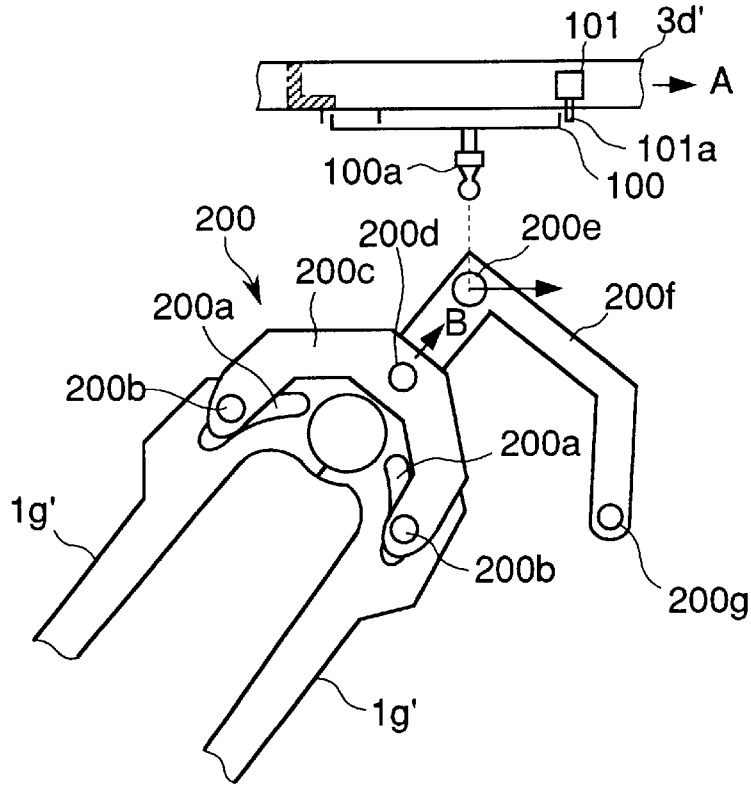
FIGS. 7A and 7B are views showing the constitution of a pin gripping mechanism of another embodiment.
Figure 7B:
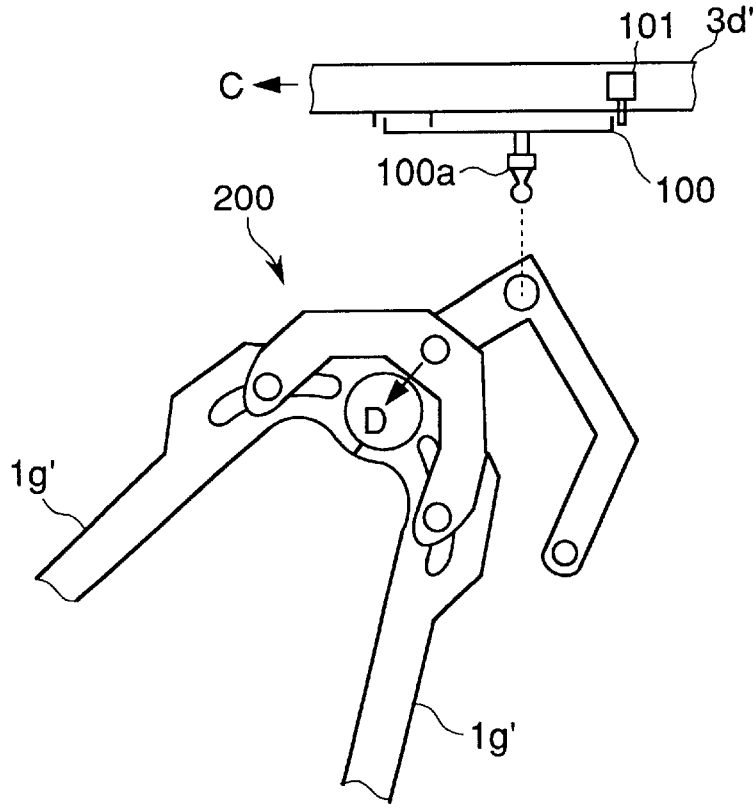

FIGS. 7A and 7B show an another embodiment. In this embodiment, the link mechanism is generally the same as in the structure shown in FIG. 1, but the structure of the connecting unit provided between the link mechanism and the scissors is different from that of the foregoing embodiment. Also, in the link mechanism, a metal fitting having an L-shaped cross section is used as hatched in the figure. The structure of the link mechanism is similar to that of FIG. 2 and so omitted in description. FIGS. 7A and 7B show a rod 3*d*' of the link mechanism of FIG. 1 (because the rod "3*d*" is not a bar-like rod but an L-shaped metallic rod, the symbol' is added to the reference numeral 3*d*) as well as scissors 1*g*' connected thereto. The case the same also with the other rod and scissors.

Figure 8A:
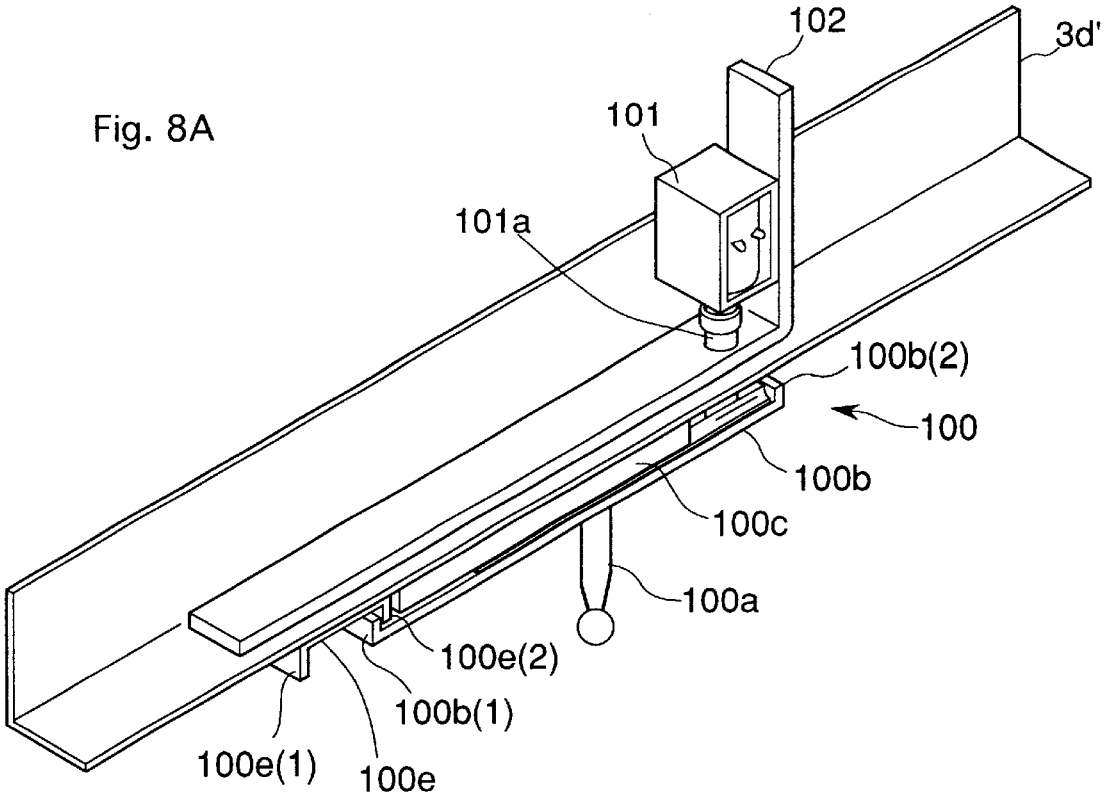
FIGS. 8A and 8B are perspective views of the pin gripping mechanism.
Figure 8B:
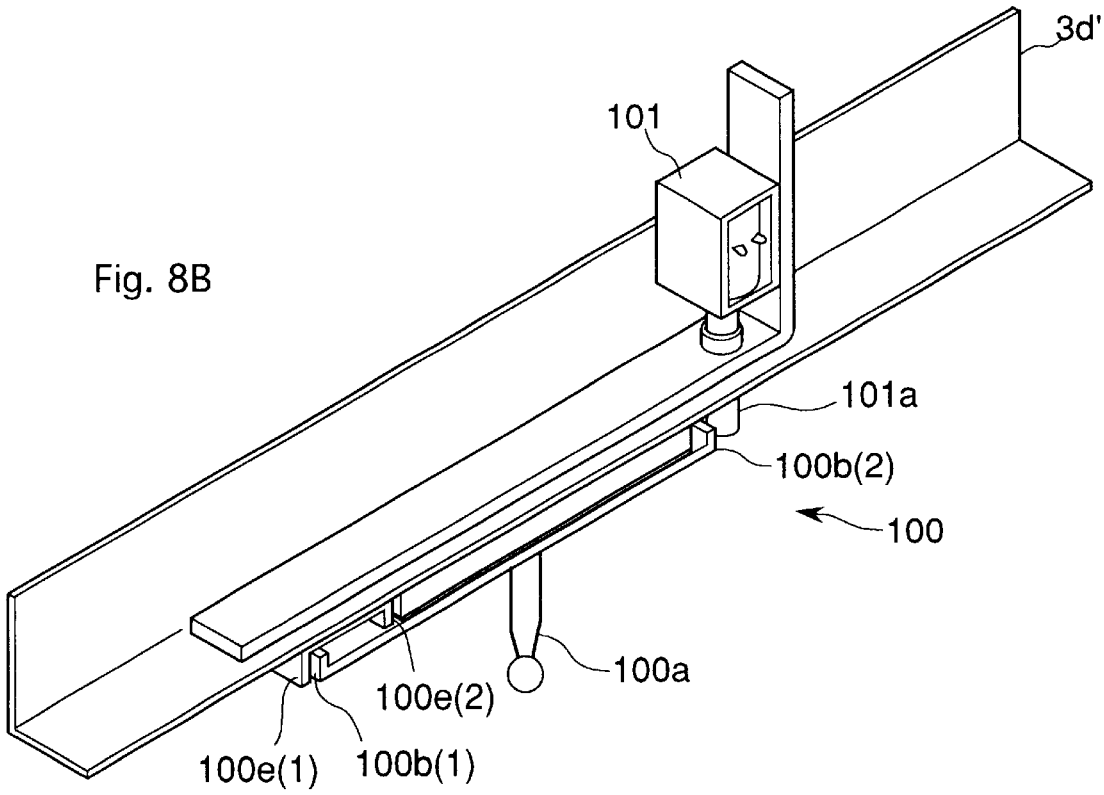
Figure 9:
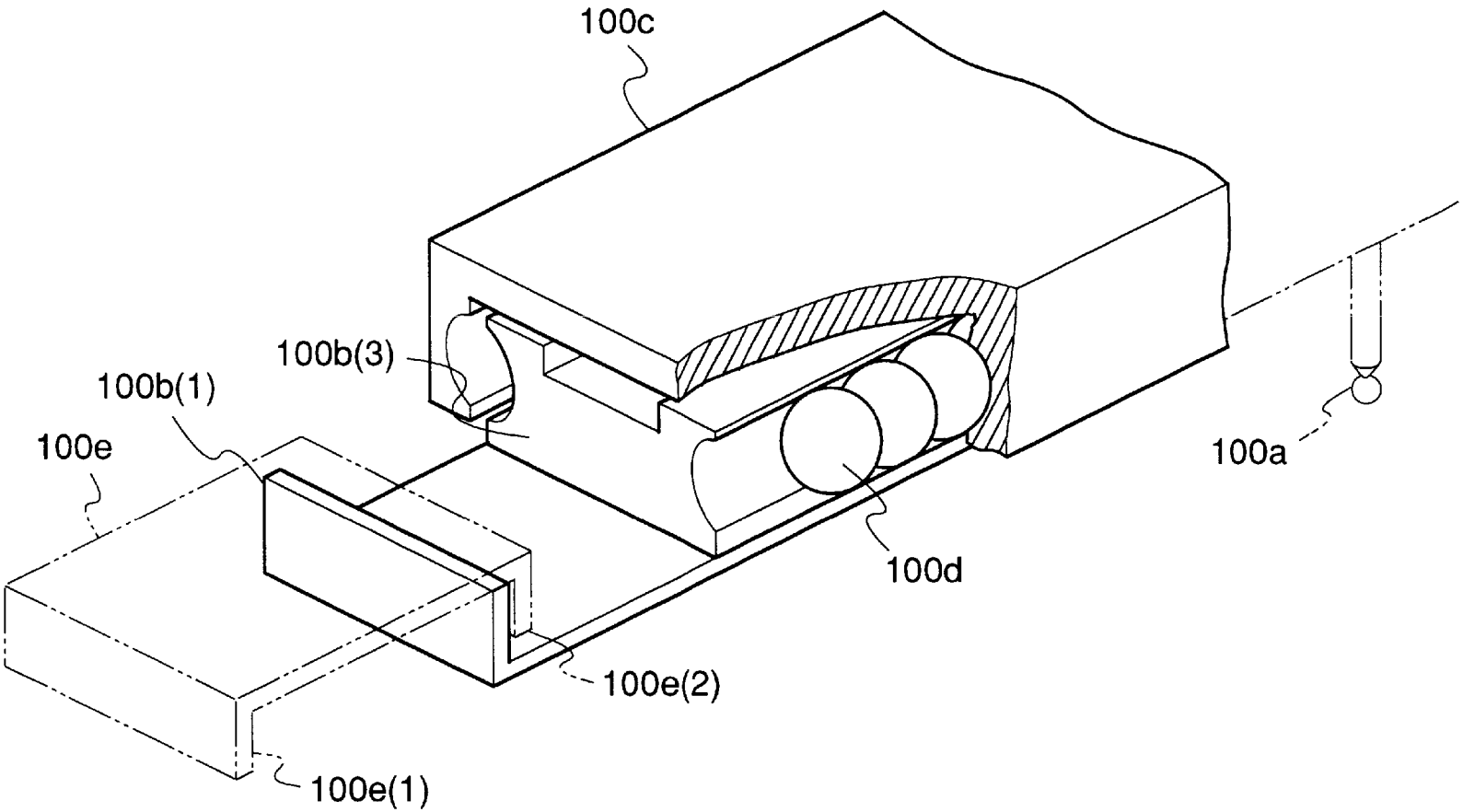
FIG. 9 is a partly cross-sectional perspective view of a slide member of the pin gripping mechanism.

Referring to FIGS. 7A and 7B, the rod 3*d*' has a slide member 100 and a solenoid 101 attached thereto by unshown screws. The slide member 100 is a lock mechanism of the present invention, having a structure as shown in FIGS. 8A and 8B. Also, FIG. 9 shows a partly cross-sectional structural view of the slide member 100. The slide member 100 comprises a slide plate 100*b* having a pin 100*a* screwed at the bottom, a ball bearing fixing frame 100*c* on which the slide plate 100*b* slides, a plurality of ball bearings 100*d* placed between the ball bearing fixing frame 100*c* and the slide plate 100*b*, and a stopper 100*e* for regulating the sliding range of the slide plate 100*b*. As shown in FIG. 9, the ball bearing fixing frame 100*c* is tunnel shaped, being curved inward at both side portions thereof so as to allow the ball bearings 100*d* to slide on. Also, the slide plate 100*b* has upwardly projecting protrusions 100*b* (1), 100*b* (2) provided at both ends, and an upwardly projecting slide plate body 100*b* (3) is provided therebetween. This slide plate body 100*b* (3) is inserted inside the ball bearing fixing frame 100*c*, with both side portions curved inward so as to allow the ball bearings 100*d* to slide on. Therefore, the ball bearings 100*d* are sandwiched between both side portions of the ball bearing fixing frame 100*c* and both side portions of the slide plate body 100*b* (3), so that the slide plate body 100*b* (3) is slidable longitudinally of the rod 3*d*' with respect to the ball bearing fixing frame 100*c*.

Further, the stopper 100*e* has downwardly projecting protrusions 100*e* (1), (2) at both ends, and this stopper 100*e* is attached to the rod 3*d*' so that the protrusion 100*b* (1) of the slide plate 100*b* is positioned between both protrusions. Therefore, in the state that the slide plate 100*b* is slidable, its sliding range extends from the position where the protrusion 100*b* (1) contacts the protrusion 100*e* (1) of the stopper 100*e* (the state shown FIG. 8B), to the position where the protrusion 100*b* (1) contacts the protrusion 100*e* (2) (the state shown in FIG. 8A).

The solenoid 101 is screwed to an L-shaped solenoid fixing plate 102, and its actuator portion 101*a* is contractible and expandable according to turn on/off of the solenoid 101. With the slide plate 100*b* moved to the leftmost position and with the solenoid 101 off as shown in FIG. 8B, this actuator portion 101*a* expands to below the rod 3*d*', contacting the protrusion 100*b* (2) of the slide plate 100*b*. In this state, the protrusion 100*b* (1) of the slide plate 100*b* is regulated by the protrusion 100*e* (1) of the stopper 100*e*, while the protrusion 100*b* (2) of the slide plate 100*b* is regulated by the actuator portion 101*a* of the solenoid 101, so that the slide plate 100*b* is inhibited from sliding rightward and leftward. FIG. 8B shows this state, which is referred to as a slide-locked state.

Meanwhile, in the state shown in FIG. 8B, when the solenoid 101 is turned on, the actuator portion 101*a* of the solenoid 101 contracts upward, being deregulated from the protrusion 100*b* (2) of the slide plate 100*b*. As a result, the slide member 100 becomes slidable within the movable range between the protrusions 100*e* (1) and 100*e* (2) of the stopper 100*e*. FIG. 8A shows this state, which is referred to as a free-slide state.

Referring to FIG. 7A, at a fulcrum portion of the scissors 1*g*' (because the shape is slightly different from that of the scissors 1*g* of FIG. 1, a symbol ' is added to the reference numeral 1*g*), is provided a transform mechanism 200 for transforming a straight motion of the pin 100*a* attached to the slide member 100, into a rotational motion of the scissors lg'.

This transform mechanism 200 comprises an elongate hole 200*a* opened in the scissors 1*g*', a pin 200*b* to be engaged with the elongate hole 200*a*, a pin support 200*c* for holding the pin 200*b*, and an arm portion 200*f* connected to the pin support 200*c* with a pin at a pivoting portion 200*d* and having a hole 200*e* connected with the pin 100*a* attached to the slide member 100. The arm portion 200*f* is further held at its end portion to an unshown chassis with a pin 200*g* so as to be pivotable at this position.

In FIG. 7A, the solenoid 101 is off, so that its actuator portion 101*a* is in the slide-locked state in which the sliding operation of the slide member 100 is locked. Therefore, in response to a straight motion of the slide member 100, the transform mechanism 200 transforms the straight motion into a rotational motion at all times. Accordingly, in the state shown in FIG. 7A, as the rod 3*d*' makes a straight motion in the direction of arrow A in the figure, the arm portion 200*f* of the transform mechanism 200 pivots clockwise so that the pin support 200*c* moves in the direction of arrow B (toward the upper right in the figure), causing the pin 200*b* to slide and move along the elongate hole 200*a*, with the result that the scissors 1*g*' are opened as shown in FIG. 7B. Also, in the state shown in FIG. 7B, as the rod 3*d*' makes a straight motion in the direction of arrow C in the figure, the arm portion 200*f* of the transform mechanism 200 pivots counterclockwise so that the pin support 200*c* moves in the direction of arrow D (toward the lower left in the figure), causing the pin 200*b* to slide and move along the elongate hole 200*a*, with the result that the scissors 1*g*' are closed as shown in FIG. 7A. In this way, the rod 3*d*' and the scissors 1*g*' can be set to a linked state.

Figure 10A:
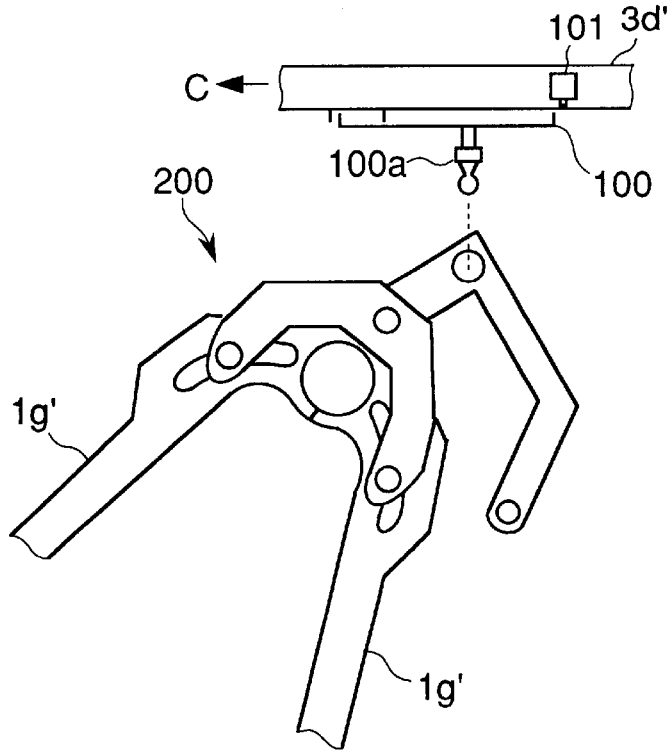
FIGS. 10A and 10B are views showing the constitution of the pin gripping mechanism.
Figure 10B:
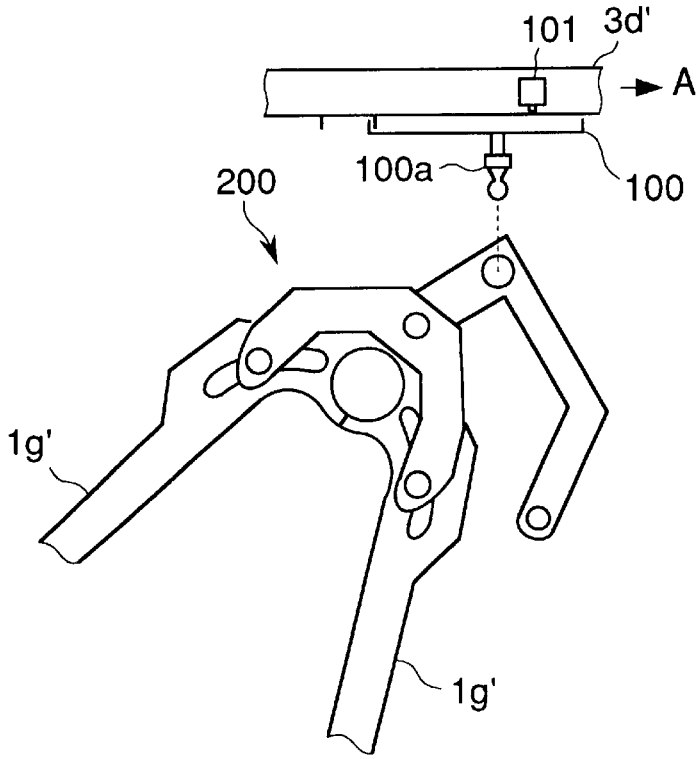

Next, when the solenoid 101 is turned on so that the sliding means is put into the free-slide state, the slide plate 100*b* slides with respect to the ball bearing fixing frame 100*c* even with a straight motion of the rod 3*d*', so that the transform mechanism 200 is not actuated. FIG. 10A shows operation of the sliding means and the transform mechanism when the sliding means is put into the free-slide state. FIG. 10A is a case in which the rod 3*d*' is moved for a straight motion in the C direction, while FIG. 10B is a case in which the rod 3*d* is moved for a straight motion in the A direction. In either case, the slide member 100 slides in response to the straight motion of the rod 3*d*', so that the transform mechanism 200 is not actuated, and therefore that the scissors 1*g*' hold the opened state. This state of FIG. 10A is the free state in which the rod 3*d*' and the scissors 1*g*' are not linked with each other.

As shown above, the linked state of FIGS. 7A and 7B and the free state of FIGS. 10A and 10B can be easily set depending on the turn on/off of the solenoid 101. Also, if a connecting unit for the slide member 100 is prepared, only by the work for attaching this connecting unit to the pin arrangement control apparatus for bowling makes it possible to set the linked state and the free state easily by later-described control.

In addition, although the slide member 100 and the transform mechanism 200 are connected to each other directly by the pin 100*a*, it is also possible that the pin 100*a* and the transform mechanism 200 are connected to each other indirectly with an appropriate link between the pin 100*a* and the hole 200*e* of the transform mechanism 200.

In this embodiment, the linked state of FIGS. 7A and 7B and the free state of FIGS. 10A and 10B correspond to the linked state of FIG. 4A and the free state of FIG. 4B, respectively, described before. Accordingly, the control of the solenoid is performed in the same manner for both embodiments, and the selective pin gripping is also performed in the same manner. In this way, a selective pin gripping mechanism similar to that of the foregoing embodiment is made up.

Figure 11A:
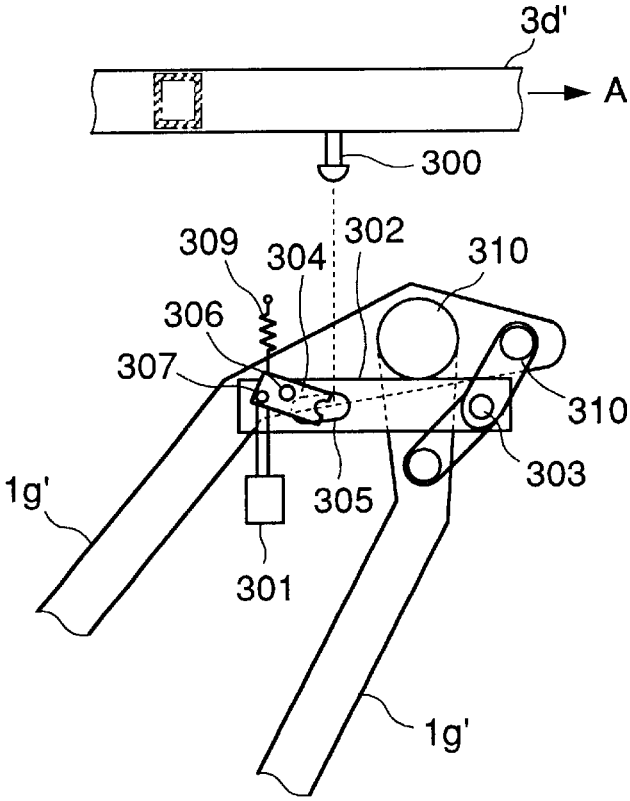
FIGS. 11A and 11B are views showing the constitution of a pin gripping mechanism of yet another embodiment.
Figure 11B:
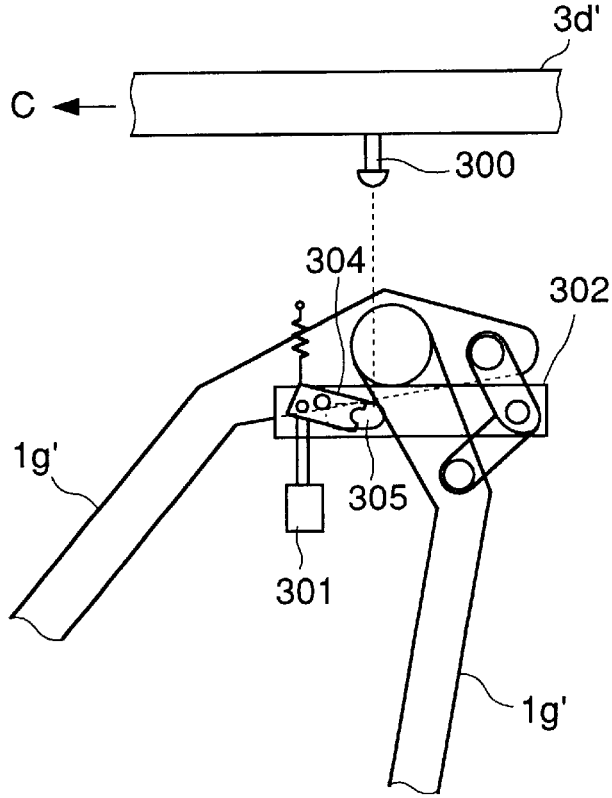

FIGS. 11A and 11B show yet another embodiment.

In this embodiment, two scissors 1*g*' are pivotably connected with a pin 310, and links 310 for transforming a straight motion into a rotational motion of the scissors 1*g*' are attached to the scissors 1*g*', respectively. A narrow, long slide plate 302 that makes straight motion is connected to the links 310 with a pin 303. By this slide plate 302 making straight motions in the rightward and leftward directions in the figure, rotational force is applied to the scissors 1*g*' via the links 310, by which the scissors 1*g*' are opened and closed.

The lock mechanism in this embodiment comprises the slide plate 302 and a pin coupling plate 304 which swings in response to the turn on/off of a solenoid 301. The slide plate 302 has an elongate hole 305 on its rather left side, and a pin 300 attached to the rod 3*d*' having a hollow, rectangular cross section is fitted to the elongate hole 305. The pin coupling plate 304 has a recess formed in its right end face, and so placed that this recessed portion covers part of the elongate hole 305 or runs away from the elongate hole 305, in response to swings of the pin coupling plate 304. Also, this pin coupling plate 304 is connected to the slide plate 302 at a swinging center 306, and a lower-left corner portion of the pin coupling plate 304 is pivotably connected to an end of the actuating portion of the solenoid 301.

With this constitution, while the solenoid 301 is off, a left end portion of the pin coupling plate 304 covers part of the elongate hole 305 of the slide plate 302 as shown in FIG. 11A. In this state, the pin 300 attached to the rod 3*d*' is completely coupled to the elongate hole 305 because the pin coupling plate 304 covers part of the elongate hole 305. Accordingly, as the rod 3*d*' moves in the A direction of FIG. 11A, the slide plate 302 also moves straight in the same direction (A direction) responsively, by which the scissors 1*g*' are opened as shown in FIG. 11B. Also, in the state of FIG. 11B, as the rod 3*d*' is moved in the C direction, the slide plate 302 also moves straight in the same direction (C direction) responsively, by which the scissors 1*g*' are closed as shown in FIG. 11A. Thus, the scissors 1*g*' and the rod 3*d*' are in the linked state.

Figure 12A:
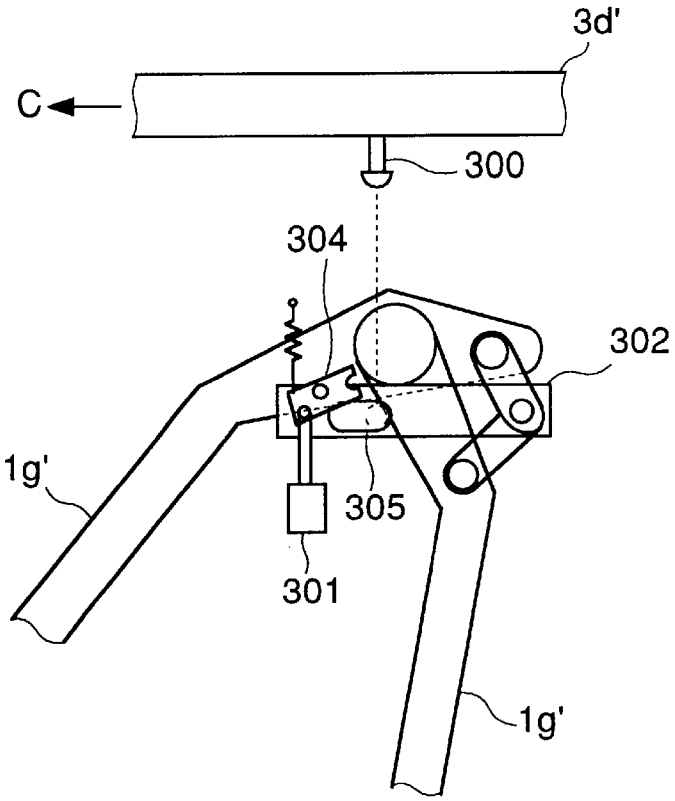
FIGS. 12A and 12B are views showing the constitution of the pin gripping mechanism.
Figure 12B:
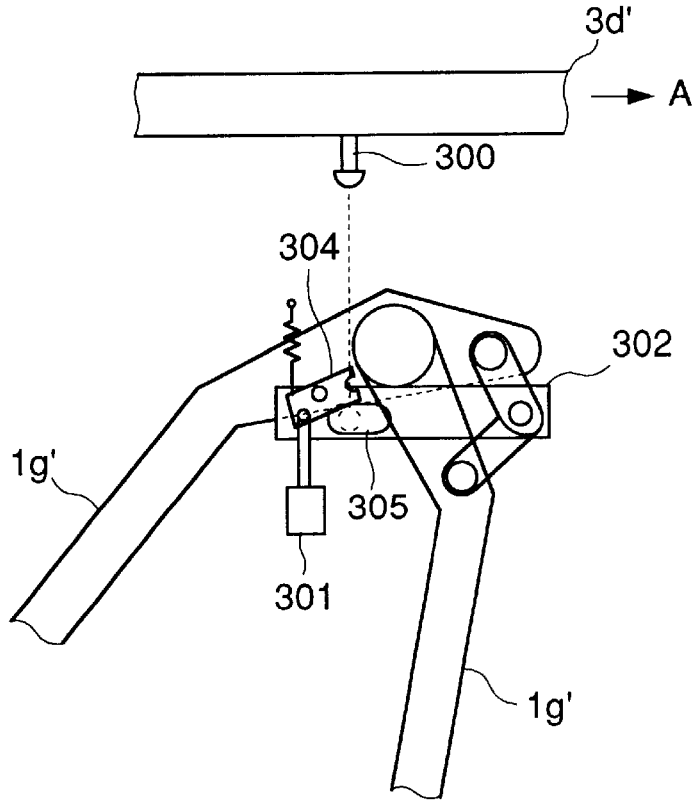

Meanwhile, in the state of FIG. 11B, as the solenoid 301 is turned on, the pin coupling plate 304 is pivoted counterclockwise as in FIG. 12A, so that the pin coupling plate 304 no longer covers the elongate hole 305. As a result, the pin 300 comes into a decoupled state with respect to the elongate hole 305, in which case even if the rod 3*d*' makes a straight motion in the C direction in the state of FIG. 12A, only the pin 300 moves within the elongate hole 305, and the slide plate 302 does not move straight. Thus, as shown in FIG. 12B, the scissors 1*g*' remain opened. Similarly, even if the rod 3*d*' is moved in the A direction in the state of FIG. 12B, the slide plate 302 does not move straight, so that the scissors 1*g*' remain opened. The state shown in FIGS. 12A and 12B is the free state between the scissors 1*g*' and the rod 3*d*'.

As shown above, in this embodiment also, the linked state and the free state between the scissors 1*g*' and the rod 3*d*' can be easily set by turn on/off of the solenoid 301. Further, such a structure can be easily made up of a unit, which comprises a slide plate 302, a pin coupling plate 304 and a spring 309, and the solenoid 301, and so can be easily assembled to existing equipment.

In addition, in this embodiment, the linked state of FIGS. 11A and 11B and the free state of FIGS. 12A and 12B correspond to the linked state of FIG. 4A and the free state of FIG. 4B, respectively, described before. Accordingly, the control of the solenoid is performed in the same manner for both embodiments, and the selective pin gripping is also performed in the same manner. In this way, a selective pin gripping mechanism similar to that of the foregoing embodiments is made up.

The solenoids shown hereinabove are controlled by a later-described machine control circuit. While the power of this machine control circuit is off, the solenoids are non-conducting so that the scissors move in linkage with the link mechanism. Therefore, by turning off the power of the machine control circuit or turning off its functions, the connecting unit using the ball latch and the solenoid is made to be one having the same functions as the conventional connecting unit, thus allowing normal bowling games to be performed.

Next, the constitution of a pin arrangement control system for bowling which allows bowling practice and normal bowling games to be exercised with the above-described pin arrangement control apparatus is described with reference to FIGS. 13 to 20. A normal game mode is a mode in which ten pins are set before a first bowl and, upon a non-strike at the first bowl, a second bowl is allowed. A bowling practice mode is a mode in which an arbitrary pin arrangement pattern can be set before a first bowl and spare practices can be exercised. This invention does not involve any change of the functions of the pin setter machine that has already been installed in the bowling alley. The pin setter machine has the functions of setting the ten pins in an initial state and, upon receiving, in this initial state, a pin setting start signal (e.g., a signal, also referred to as machine set signal, which is given to the pin setter machine upon pressing a reset button which is to be pressed to sweep away remaining pins that have been left after a non-strike result of the third bowl in the tenth frame in the normal bowling game), lowering the scissors, elevating standing pins, sweeping fallen pins, and rearranging the elevated pins. In this invention, when the bowling practice mode is set, a signal for conduction and non-conduction of the individual solenoids as well as a "false" pin setting start signal are fed to the pin setter machine without changing these functions of the pin setter machine. Even if no actual bowl has been made, the pin setter machine, upon receiving this "false" pin setting start signal, performs the above operation immediately from the initial state. In this case, a set pin arrangement is set up depending on the signals for conduction or non-conduction for the solenoids. As a result, the bowler is allowed to exercise spare practice from the beginning.

Figure 13:
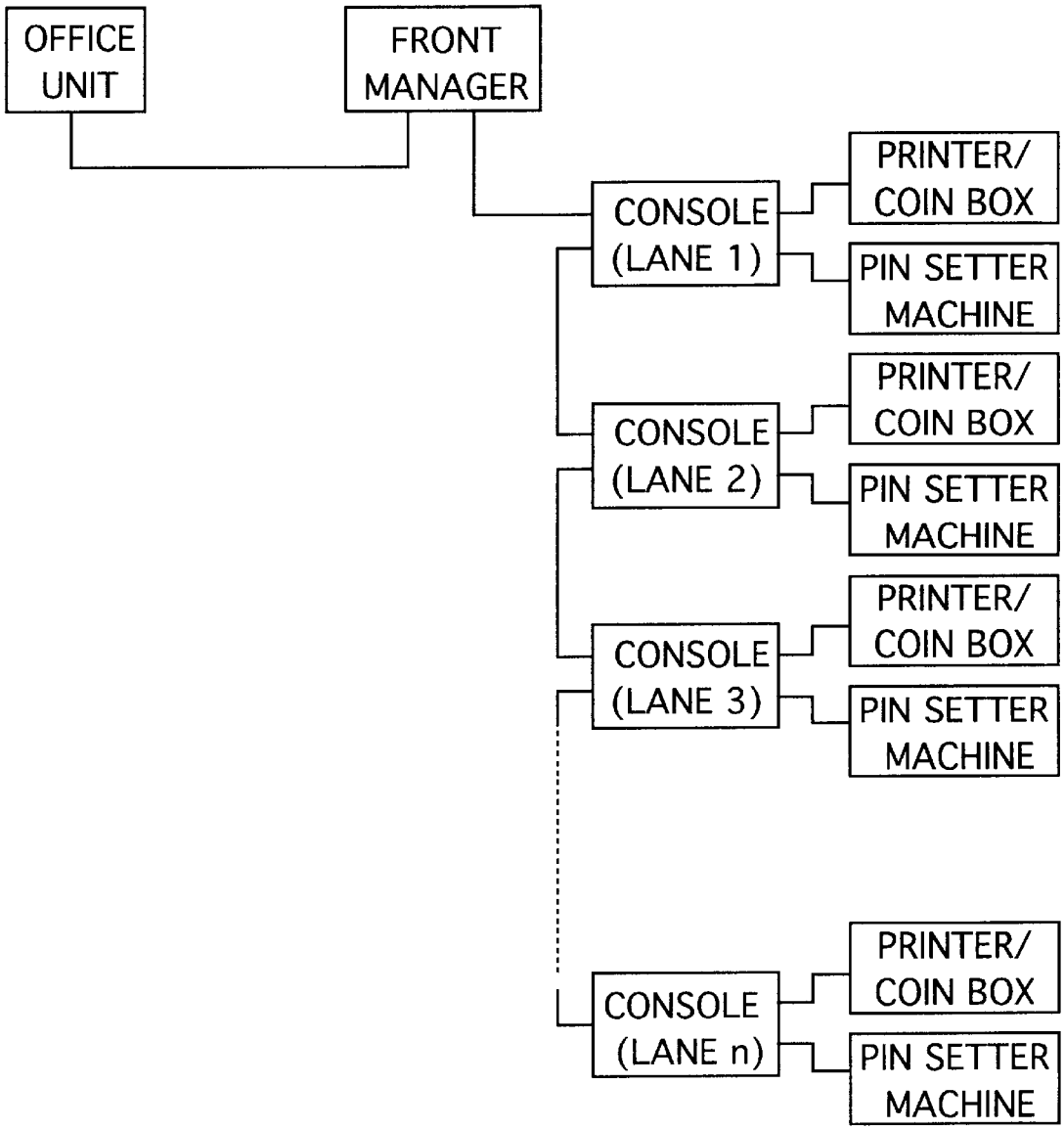
FIG. 13 is a block diagram showing the constitution of the whole pin arrangement control system for bowling.

FIG. 13 is a block diagram showing the constitution of the whole system. In this case, consoles are provided for individual lanes, one for each, and a later-described printer/coin box and the pin setter machine are connected to each of these consoles. Also, a plurality of these consoles, a front manager and an office unit are connected together via a LAN (Local Area Network). The front manager is a host unit provided in the front to perform the reception of bowlers, the control of specified consoles and the management of use state in each console. The office unit is provided in the office to perform other tasks of bowlers management and administrative management.

It is noted that when the printer/coin box is provided for each console as shown in FIG. 13, the interconnection with the front manager is not necessarily required, and the consoles may operate independently of one another. Besides, if charge management and score print are left to the front manager side, there is no need of providing the "printer/coin box" on the console side.

Figure 14:
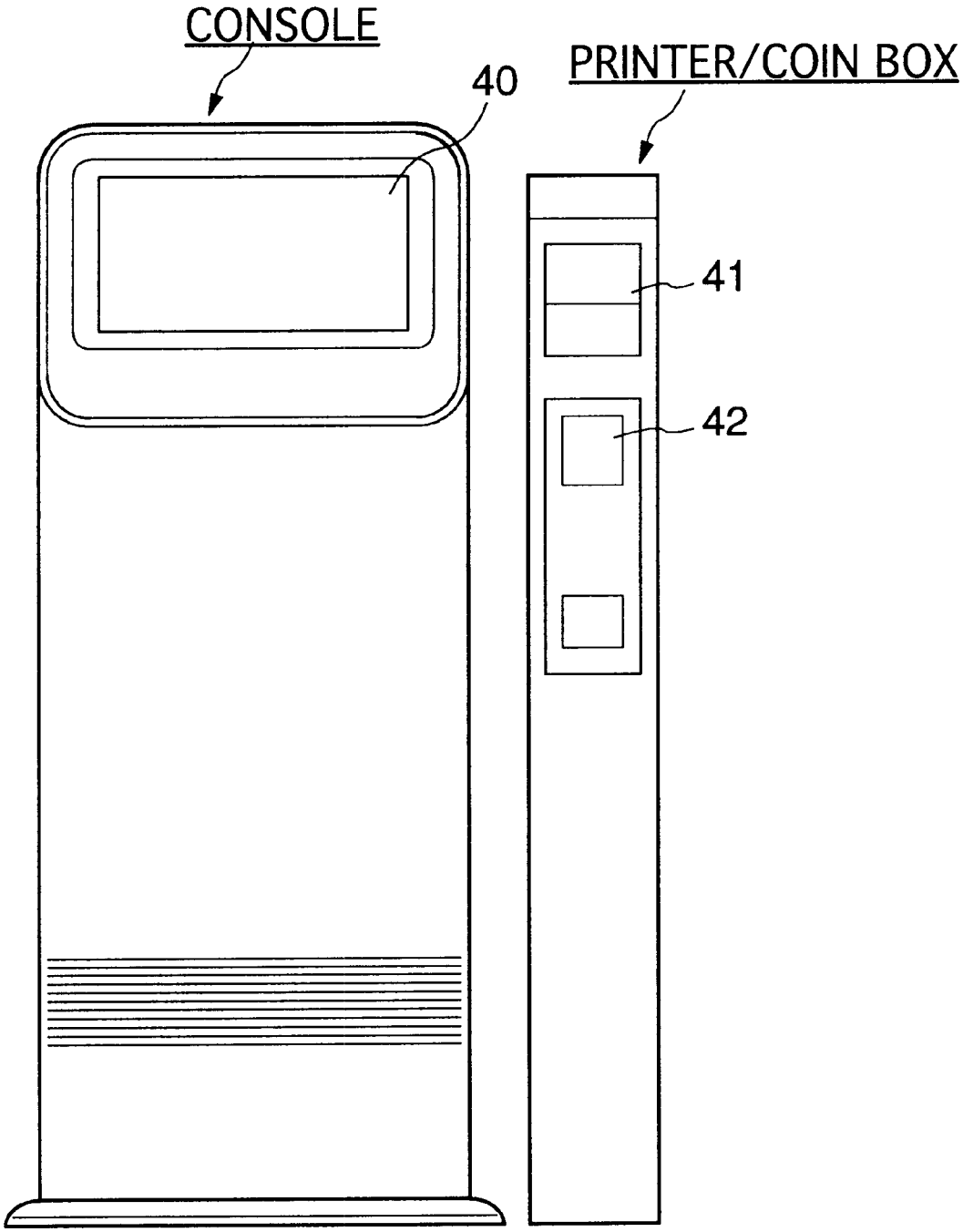
FIG. 14 is an appearance view of a console and a printer/coin box.

FIG. 14 is an appearance view of the console and the printer/coin box. A monitor 40 with a touch panel is provided on the front of the console, for a bowler to make a touch operation in accordance with its display contents as required. The printer/coin box has a coin slot 42 and a print paper receiver 41 on the front.

Figure 15:
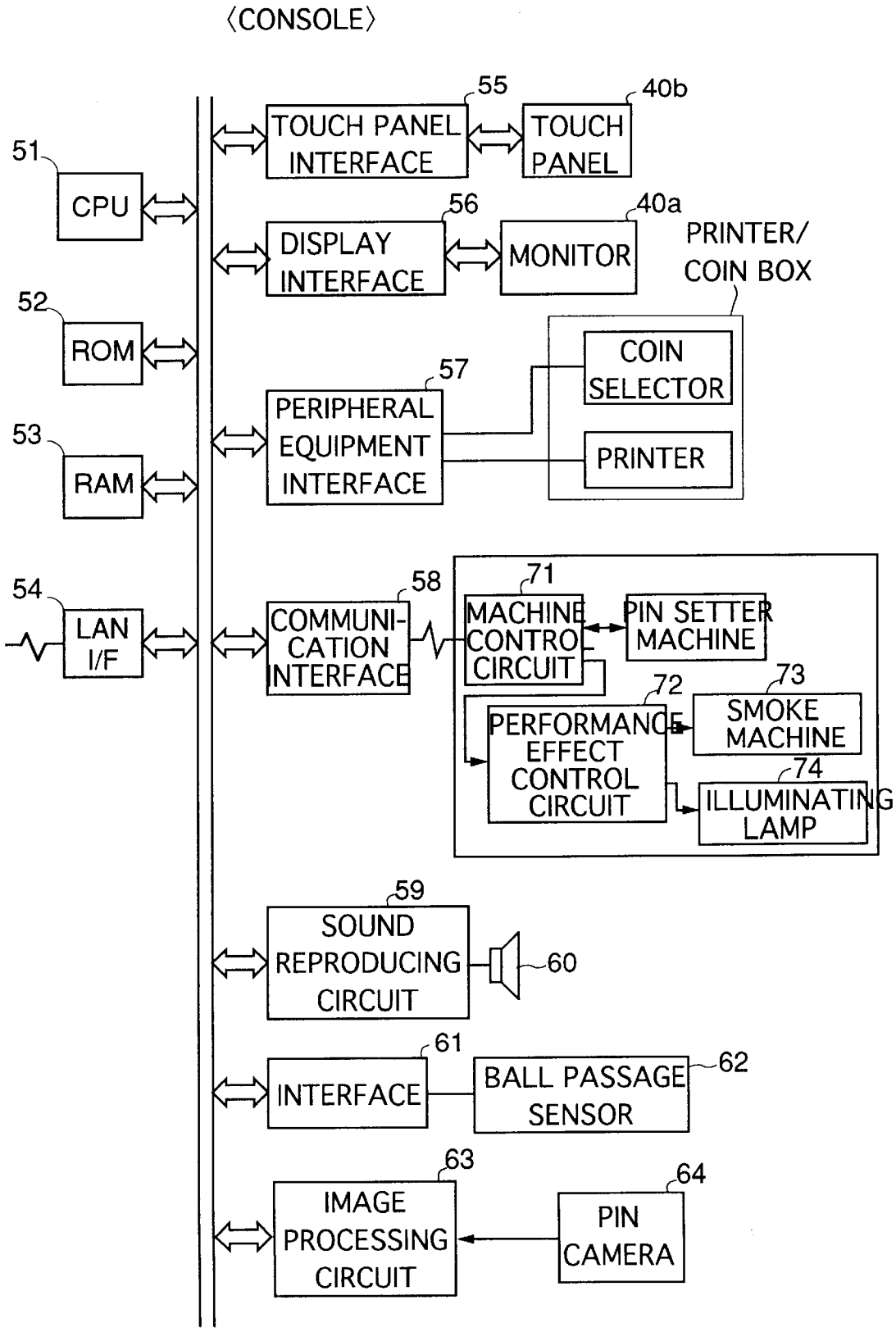
FIG. 15 is a block diagram showing the constitution of the console and individual sections to be connected thereto.

FIG. 15 is a block diagram showing the constitution of the console and the printer/coin box. A CPU 51 executes programs previously written in a ROM 52. A RAM 53 is used as a working area for temporary storage of various data for the execution of the programs. A LAN interface 54 performs the control of the local area network.

A touch panel interface 55 detects an input operation of the touch panel of the touch-panel-equipped monitor. The CPU 51 reads contents of a touch operation via this touch panel interface 55. A display interface 56 gives a display signal to a monitor 40*a*, which is a monitor equipped with a touch panel. This display interface 56 is equipped with a display memory and a circuit for generating a display signal from contents of the display memory, and the CPU 51 writes display data into the display memory.

A peripheral equipment interface 57 controls the printer/coin box. A coin selector of the printer/coin box reads and discriminates the type of an input coin, and the CPU 51 reads the input amount via the peripheral equipment interface 57. Whereas coins are received in this example, some media other than value-stored coins such as IC memory cards or magnetic cards may also be received. As the card in which values are stored, credit cards or cards that allow withdrawal from the owner's bank account may be used. In the case where such a card is received, a card reader/writer is provided in the printer/coin box, and the CPU 51 reads the value of the inserted card via the peripheral equipment interface 57 and subtracts from the card a value corresponding to the number of bowls or the like. The printer of the printer/coin box prints out scores or the like. The CPU 51 outputs print data to the printer via the peripheral equipment interface 57.

A communication interface 58 performs communication control with a machine control circuit 71 provided on the pin setter machine side. The CPU 51 outputs a specified command to the machine control circuit 71 via this communication interface 58. A sound reproducing circuit 59 is a circuit for reproducing several effect sounds, synthetic sounds and the like, and the CPU 51 gives this sound reproducing circuit 59 such data as sound effects and synthetic sounds to be reproduced, by which the data is outputted from a loudspeaker 60.

A ball passage sensor 62 is a sensor for detecting that a bowled ball has passed on the lane, and the CPU 51 reads a result of the detection via an interface 61. A pin camera 64 is a camera for picking up an image of the pin arrangement position, and an image processing circuit 63 detects erect pins at specified positions from an image pickup signal of the pin camera 64.

Also, as shown in FIG. 15, a performance effect control circuit 72 is connected to the machine control circuit 71, and a command for a performance effect received from the console is given to the performance effect control circuit 72. To this performance effect control circuit 72, are connected a smoke machine 73 for first hiding the ten pins to be arranged into the pin arrangement position and then exerting such performance as if the pins of a specified pin arrangement pattern emerged from within smoke, as well as an illuminating lamp 74 for illuminating the pin arrangement position.

Figure 16:
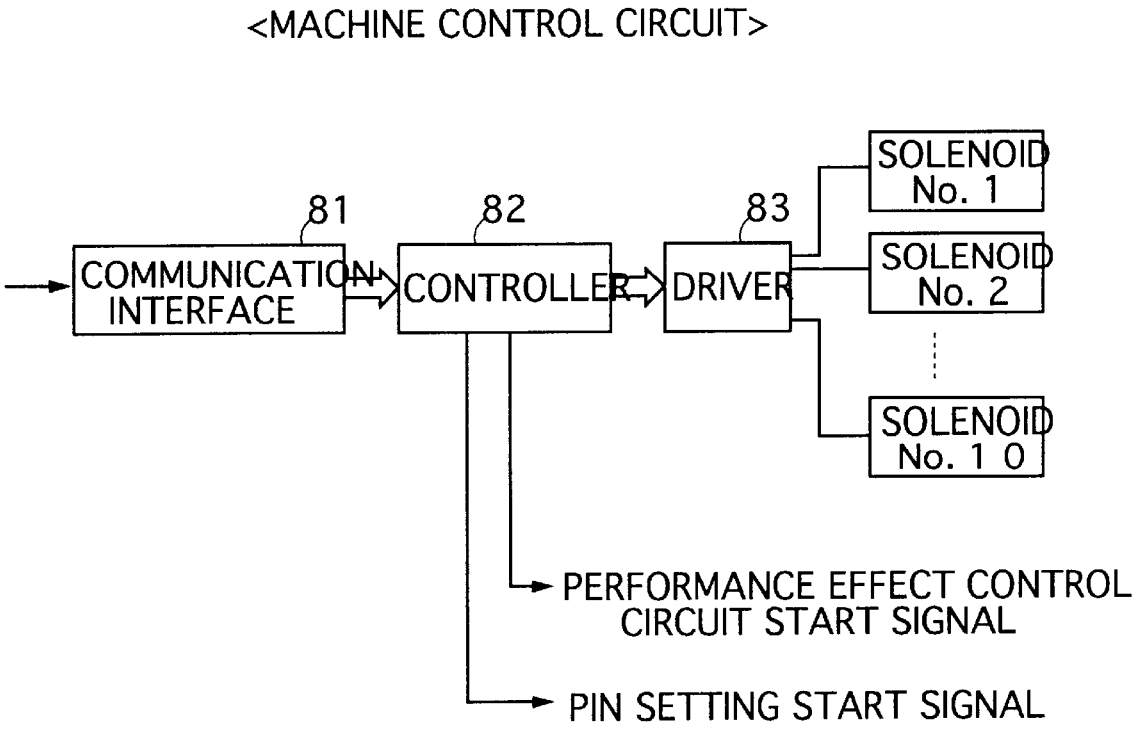
FIG. 16 is a block diagram showing the constitution of a machine control circuit.

FIG. 16 is a block diagram showing the constitution of the machine control circuit. In this case, a communication interface 81 performs communication control in conjunction with the console and receives various commands given from the console. In response to the commands, a controller 82 gives the pin setter machine a pin setting start signal to cause the pin setter machine to perform pin setting. Also, the controller 82 gives a start signal to the performance effect control circuit. Further, in response to the pin arrangement pattern, a driver 83 is driven. The driver 83 controls the conduction of the ten solenoids provided in the connecting unit.

The machine control circuit, which controls the conduction of the ten solenoids of the selective pin gripping mechanism provided in the pin setter machine, gives a pin setting start signal to the pin setter machine, thereby causing the pin setter machine to perform a specified pin setting. Basically, the following procedure is taken.

Generally, the initial state is that the pin setter machine sets ten pins, ready for the first bowl. In the normal bowling game (normal game mode), the bowler performs the first bowl in this state (hereinafter, this pin setting operation will be referred to as "first-bowl pin setting"). However, in the bowling practice mode in which spare practice is done, the bowler does not bowl actually in the state that the ten pins are set. A bowl will be done after a specified pin arrangement pattern has resulted out of the pin arrangement of the ten pins.

In the bowling practice mode, the machine control circuit, in this state, makes conduction through solenoids corresponding to unwanted pins, thereby setting free the connecting units corresponding to the solenoids. Then, a "false" pin setting start signal is given to the pin setter machine. This pin setting start signal is, for the pin setter machine, a signal to be generated when a bowled ball, which has been done for the first bowl in the ten-pin arrangement state in the normal game, arrives at the pin setter machine. Accordingly, upon receiving this "false" pin setting start signal in this bowling practice mode, the pin setter machine decides that the first bowl has been done in the ten-pin arrangement state, and performs a pin re-setting operation for the second bowl (hereinafter, this pin setting operation will be referred to as "second-bowl pin setting"). That is, the pin setter machine automatically performs a sequence of operations of gripping the ten pins by the pin gripping mechanism, elevating, sweeping with the rake and lowering them again for rearrangement. However, actually, the pins corresponding to the solenoids that have been made conducting are not gripped, swept by the rake, while the remaining pins that are actually gripped are rearranged. Then, the pin setter machine is ready for the second bowl in the normal game mode. For the bowler, however, it is not the second bowl but the first bowl for the pins of the specified pin arrangement pattern that has been set this time.

Figure 17:
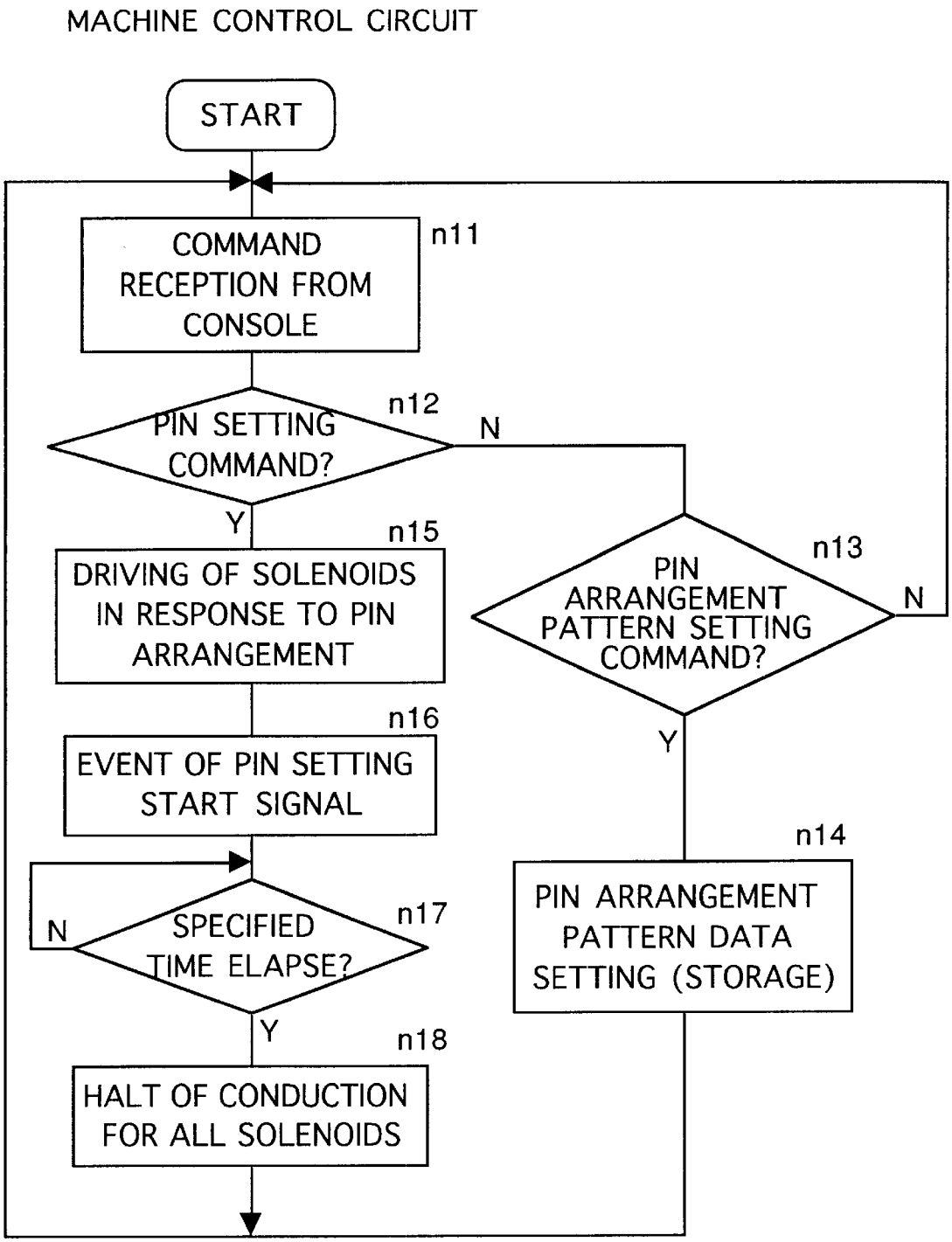
FIG. 17 is a flowchart showing a procedure of the controller of the machine control circuit.

FIG. 17 is a flowchart showing a procedure of the controller 82 of the machine control circuit 71 in the bowling practice mode. First, a command is received from the console. In the case where the bowling practice mode is set, a pin arrangement pattern setting command and a pin setting command are received, in this order, as the above command. If the received command is a pin arrangement pattern setting command, then pin arrangement pattern data subsequent to the command are stored (n11→n12→n13→n14). If the received command is a pin setting command, then the solenoids are driven in accordance with the pin arrangement pattern that has already been given from the console, so that a "false" pin setting start signal is given to the pin setter machine (n15→n16). As stated above, for the pin setter machine, the state that the ten pins are set ready for the first bowl is the initial state. Therefore, before the pin setting command is received from the console, the ten pins have already been set. Accordingly, through the processes of the steps n15 and n16, the pin setter machine is made to perform the "second-bowl pin setting" operation, by which pin setting for the specified pin arrangement pattern is achieved. In addition, as stated before, in a specified time elapse after the "false" pin setting start signal is given, conduction to all the solenoids is halted (n17→n18). This specified time elapse is the time elapsing since specified pins are elevated and swept by the rake, until the pins are lowered again so that the scissors are going to open. As a result of these operations, all the connecting units return to the linked state.

Figure 18A:
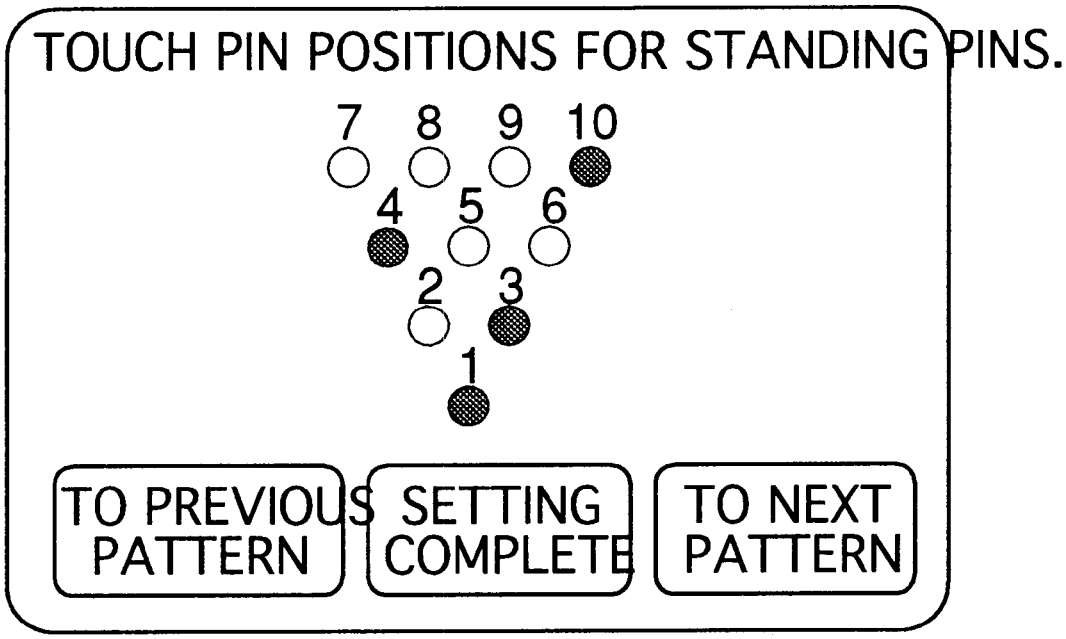
FIGS. 18A and 18B are views showing display examples in the console.
Figure 18B:
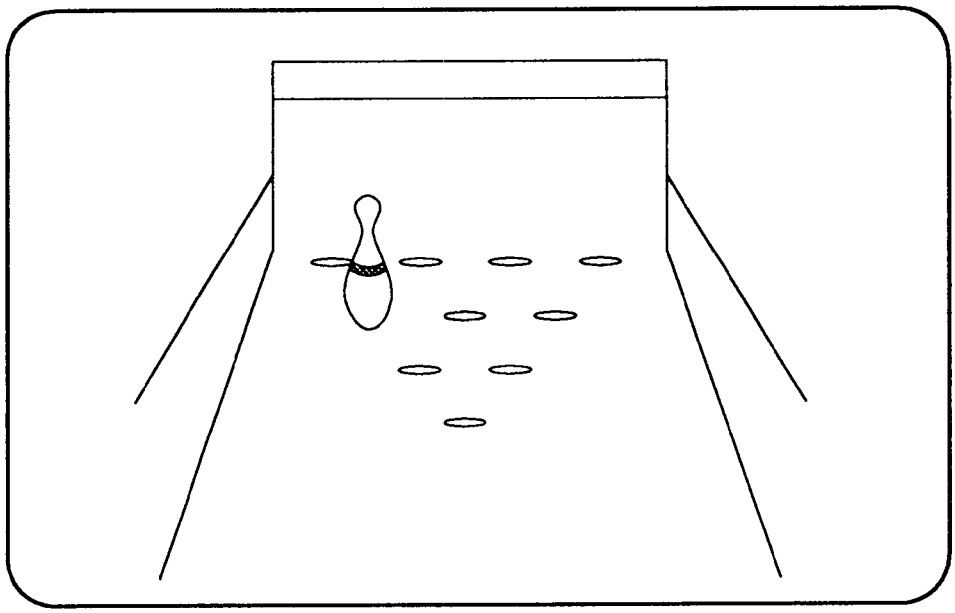

FIGS. 18A and 18B are views showing display examples of the console. When a coin of a predetermined specified amount is inputted through the coin slot of the printer/coin box, an initial screen as shown in FIG. 18A is displayed. In this screen, by touching a pin arrangement pattern for the ten pins, a pin arrangement pattern is set. Once a desired pin arrangement pattern has been set, the "SETTING COMPLETE" button is touched, by which the play is started. Otherwise, with preparations that several patterns are previously stored as pin arrangement patterns for spare practice, the "TO NEXT PATTERN" button is touched, by which the next pin arrangement pattern is displayed. Each time this "TO NEXT PATTERN" button is touched, the stored pin arrangement patterns are read out and displayed sequentially. Also, when the "TO PREVIOUS PATTERN" button is touched, the display returns to the precedently displayed pin arrangement pattern. Each time this "TO PREVIOUS PATTERN" button is touched, the stored pin arrangement patterns are sequentially displayed in the reverse order. To partly change the pin arrangement pattern read by the "TO NEXT PATTERN" button or "TO PREVIOUS PATTERN" button, the displayed pin arrangement position is touched, by which the pin arrangement pattern is changed. Once a desired pin arrangement pattern has been set, the "SETTING COMPLETE" button is touched, by which the play is started.

When a bowl is done, the remaining pins are displayed three-dimensionally and graphically as shown in FIG. 18B. This allows the bowler to exercise the spare practice by a specified pin arrangement pattern, effectively.

In addition, although a desired pin arrangement pattern is set through operations of the touch panel in the example of FIGS. 18A and 18B, the input part may be implemented by key switches.

Figure 19:
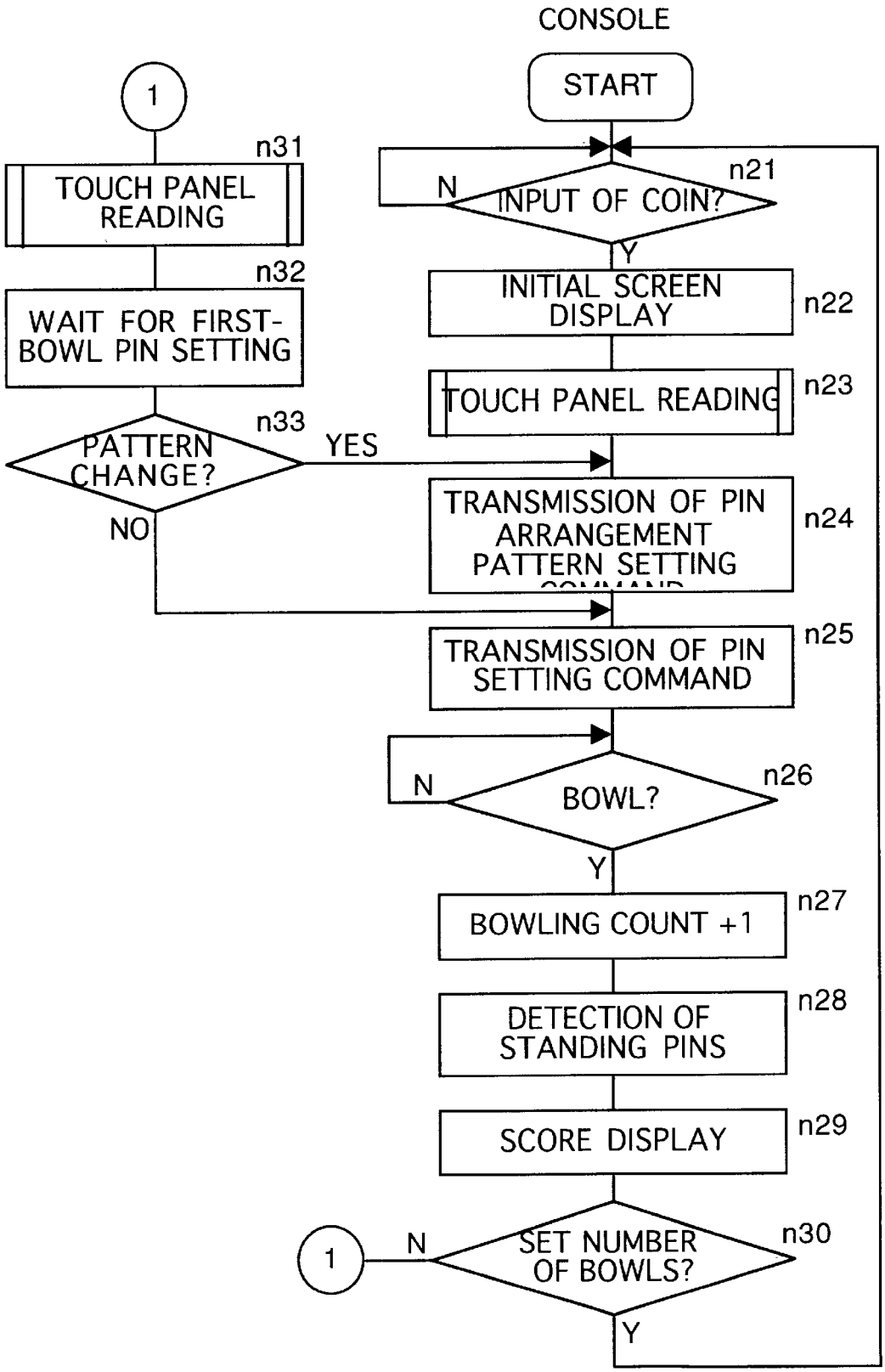
FIG. 19 is a flowchart showing a procedure of the console.
Figure 20:
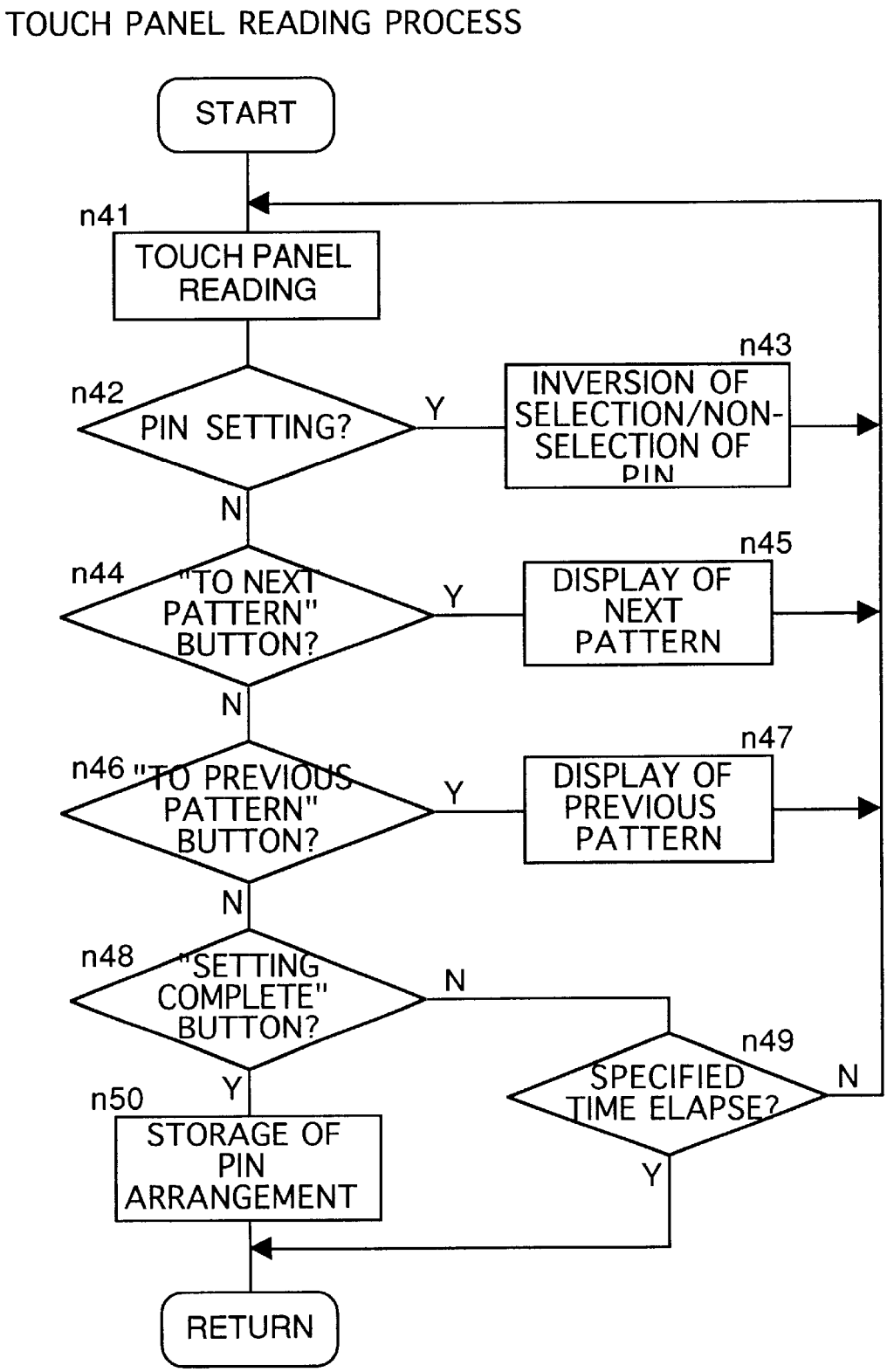
FIG. 20 is a flowchart showing a procedure of the console.

FIG. 19 and FIG. 20 are flowcharts showing procedures of the console. First, after awaiting a coin input and when a specified amount coin is inputted, the bowling practice mode is set, an initial screen as shown in FIGS. 18A and 18B is displayed, and a touch panel reading is done (n21→n22→n23). FIG. 20 is a flowchart showing the procedure for touch panel reading process. When any pin position is touched, the selected/non-selected state of the corresponding pin is inverted (n41→n42→n43). In FIG. 18A, a black circle denotes the selected state and a white circle denotes the non-selected state. Also, when the "TO NEXT PATTERN" button is touched, the stored pin arrangement patterns are sequentially displayed each time the button is touched as stated above (n44→n45). Likewise, when the "TO PREVIOUS PATTERN" button is touched, the stored pin arrangement patterns are displayed in the reverse order each time the button is touched as stated above (n46→n47). After a desired pin setting has been done by these operations and when the "SETTING COMPLETE" button is touched, the pin arrangement pattern is stored (n48→n50).

Thereafter, as shown in FIG. 19, the pin arrangement pattern data set by the touch panel operation at this time (pin arrangement pattern data stored at the step n50) is transmitted to the machine control circuit as the pin arrangement pattern setting command (n24). Subsequently, a pin arrangement command is transmitted to the machine control circuit (n25). As a result, the machine control circuit controls the pin setter machine by the control shown in FIG. 17 so that the pin setter machine performs the pin setting for the set pin arrangement pattern. After that, a bowl by the bowler is awaited (n26). When the bowl has been done, the number of bowls is counted and the current pin state is displayed as shown in FIG. 18B, by which score count and score display are performed (n27→n28→n29).

In response to this bowl, the pin setter machine performs the "first-bowl pin setting" by its own function. That is, in response to the arrival of the ball of this bowl, the pin setter machine decides that the second bowl has been done, and automatically performs the operation of setting the new ten pins.

Thereafter, a touch panel reading is done (n31). If the bowler operates the touch panel at this time point so that a new pin arrangement pattern is set, a time elapse required to set the pin arrangement of the ten pins is awaited and then a pin arrangement pattern setting command as well as a pin arrangement command are transmitted to the machine control circuit again (n31→n32→n33→n24→n25). For example, in the pin arrangement pattern shown in FIG. 18A, if the 6th pin position is touched and then the "SETTING COMPLETE" button is touched, then the 1st, 3rd, 4th, 6th and 10th pins are set.

In this connection, if the bowler has not operated the touch panel, or if the time has expired before touching the "SETTING COMPLETE" button (n49 RETURN in FIG. 20), then the pin arrangement pattern is not changed so that the pin setting command alone is transmitted to the machine control circuit after an elapse of the time required to set the ten pins (n32→n33→n25). As a result, a pin setting for the same pin arrangement pattern is done again and the bowler bowls. If the predetermined number of bowls is completed, the processing is ended, awaiting the next input of a coin (n30→n21).

As described hereinabove, spare practice can be effectively exercised.

Next, an example of the system in which, substantially, only the machine control circuit connected directly to the pin setter machine is used is described with reference to FIGS. 21 to 23.

Figure 21:
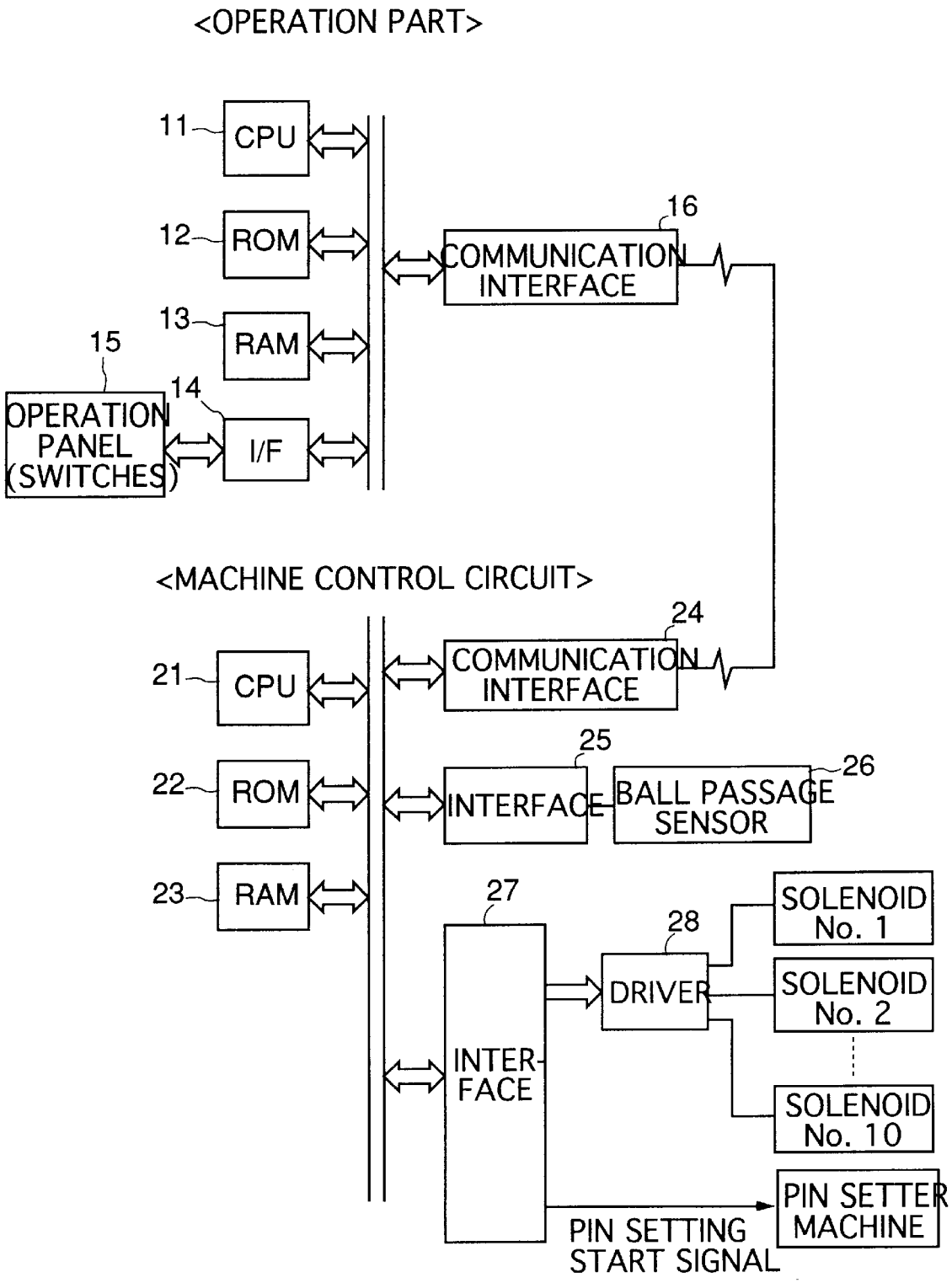
FIG. 21 is a block diagram showing the constitution of an operation part and the machine control circuit.

FIG. 21 is a block diagram showing the constitution of an operation part and the machine control circuit. This operation part is placed near the console, but not linked with the console as an existing bowling scorer. Also, the machine control circuit is placed on the pin setter machine side, and both of them are connected to each other via a serial communication cable.

A CPU 11 in the operation part executes programs previously written in a ROM 12. A RAM 13 is used as a working area for temporarily storing the contents of operations by the bowler during the execution of the programs. An operation panel 15 has key switches arranged into the pin arrangement configuration of the 1st to 10th pins, and an LED for displaying its operation position, where the CPU 11 reads operation contents via an interface 14 and turns on/off the LED in response to the operation. A communication interface 16 performs communication control in conjunction with the machine control circuit.

A CPU 21 of the machine control circuit executes programs previously written into a ROM 22. A RAM 23 is used as a working area for temporarily storing pin arrangement pattern data during the execution of the programs. A communication interface 24 performs communication control in conjunction with the operation part. A ball passage sensor 26 is a sensor for detecting that a bowled ball has passed on the lane, and the CPU 21 reads a result of the detection via an interface 25. Also, the CPU 21 outputs a pin setting start signal for the "second-bowl pin setting" to the pin setter machine via an interface 27. A driver 28 is a circuit for driving the already described ten solenoids, and the CPU 21 outputs a signal to the driver 28 via the interface 27, thereby driving specified solenoids.

Figure 22:
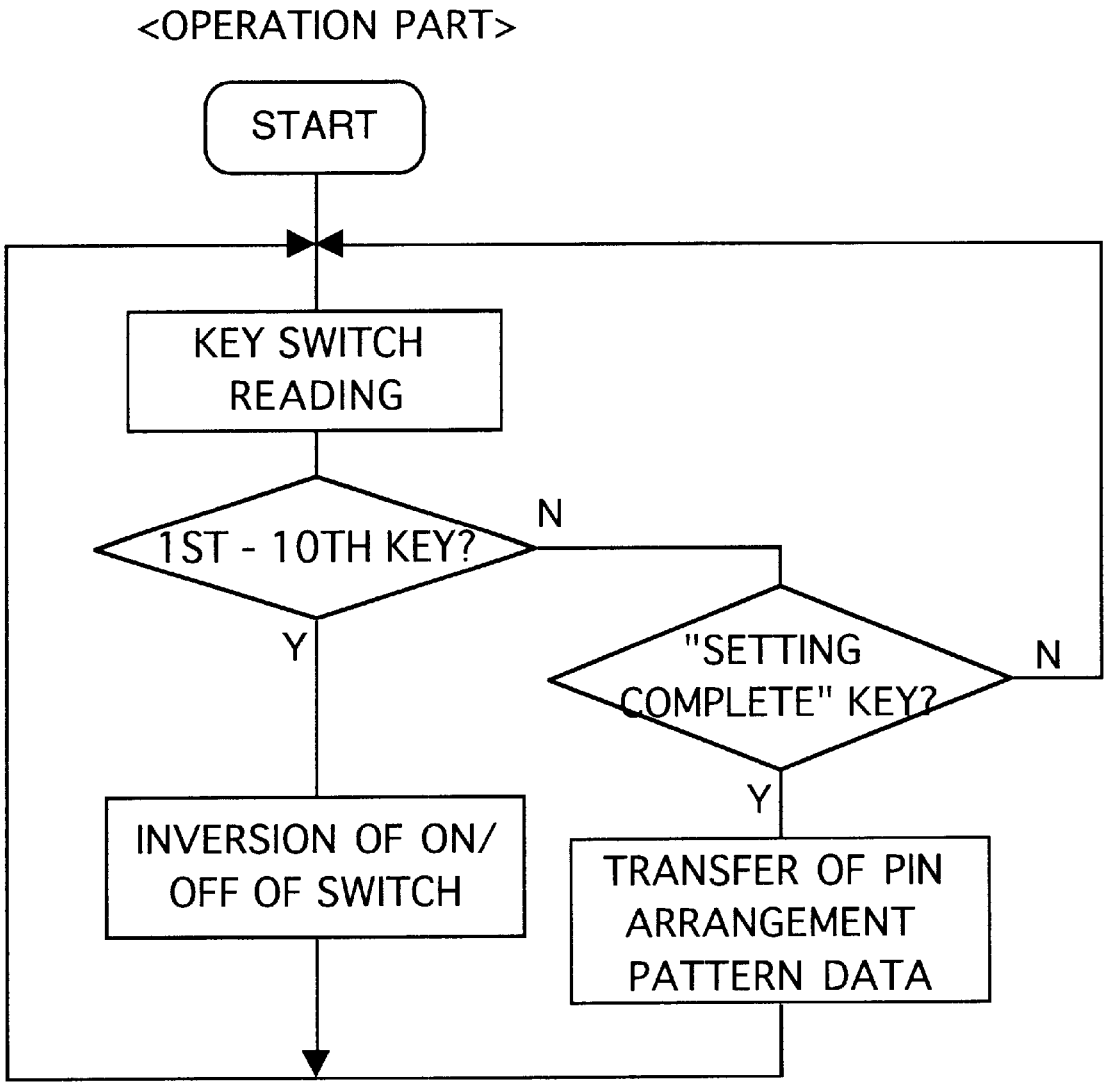
FIG. 22 is a flowchart showing a procedure of the operation part.

FIG. 22 is a flowchart showing a procedure of the operation part. First, an operation of the key switches by the bowler is read, and the LED of the corresponding switch portion is lit (where if a key switch with the LED lit is operated, the LED is turned off). Then, if the setting complete key is operated, it is decided that a pin corresponding to the key switch with the LED lit is selected, and its corresponding pin arrangement pattern data is transferred to the machine control circuit.

Figure 23:
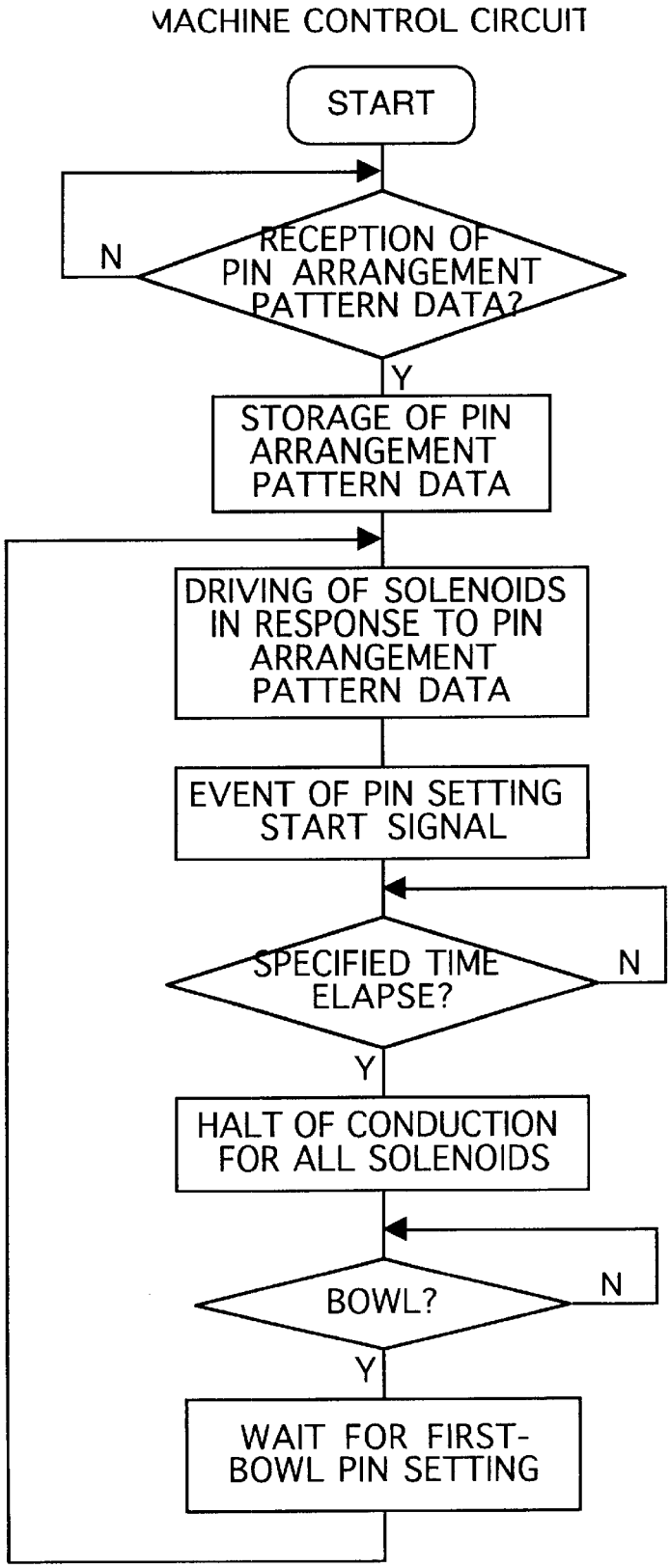
FIG. 23 is a flowchart showing a procedure of the machine control circuit.

FIG. 23 is a flowchart showing the procedure of the machine control circuit. First, transfer of pin arrangement pattern data from the operation part is awaited. Upon receiving this data, the machine control circuit stores the data, drives solenoids in response to the pin arrangement pattern, and feeds a pin setting start signal to the pin setter machine. As a result, the pin setter machine sets up pins in the specified pin arrangement pattern. Thereafter, in a specified time elapse, conduction to all the solenoids is halted. This specified time elapse is the time elapsing since specified pins are elevated and swept by the rake, until the pins are lowered again so that the scissors are going to open. As a result of these operations, all the connecting units return to the linked state.

Thereafter, upon detection of a bowl that has actually been done by the bowler, a time elapse required for the pin setter machine to set the ten pins for the first-bowl pins is awaited, and the machine control circuit drives solenoids in response to the pin arrangement pattern, and feeds a pin setting start signal to the pin setter machine, again. As a result, the pin setter machine sets up pins in the specified pin arrangement pattern once again. After this on, similar processes are iterated until new pin arrangement pattern data is received from the operation part.

The present invention is useful as apparatus and systems which can offer new bowling games and effective bowling practice, and which can modify already widespread pin setter machines so as to allow pin arrangement to be implemented in arbitrary pin arrangement patterns, without entirely replacing the pin setter machines.

What is claimed is:

1. A pin arrangement control apparatus, comprising:

scissors for pinching a neck portion of a bowling pin;

a link mechanism for performing an opening/closing operation of the scissors, including a rod with a circumferential groove configured to receive a plurality of balls; and a connecting unit provided between the scissors and the link mechanism, including a solenoid which is set to an actuation state of conducting or non-conducting, and a lock mechanism for setting the scissors and the link mechanism into a linked state or a free state therebetween in response to the actuation state of the solenoid, the lock mechanism further comprising:

a pipe which is slidably disposed about said rod and said groove, said pipe being further attached to the scissors; and a plurality of balls held by the pipe, wherein the pipe and the rod are put into a latched state or a non-latched state by making the balls fitted or non-fitted to the groove depending on the actuation state of the solenoid, and in said linked state, said connecting unit transfers motion of said link mechanism to said scissors, causing said scissors to open or close.

2. The pin arrangement control apparatus, comprising:

scissors for pinching a neck portion of a bowling pin;

a link mechanism for performing an opening/closing operation of the scissors; and a connecting unit provided between the scissors and the link mechanism, including a solenoid which is set to an actuation state of conducting or non-conducting, and a lock mechanism for setting the scissors and the link mechanism into a linked state or a free state therebetween in response to the actuaction state of the solenoid, wherein in said linked state, said connecting unit transfers motion of said link mechanism to said scissors, causing said scissors to open or close, the solenoid includes an actuation portion whose position is dependent upon the actuation state of the solenoid, the lock mechanism includes a slide member which is attached to the link mechanism and which is engaged in a slide-locked state when in contact with the actuation portion of the solenoid, and is engaged in a free-slide state when not contacted by the actuation portion of the solenoid, and the scissors and the link mechanism are put into a linked state or a free state therebetween by putting the slide member into a free-slide state or the slide-locked state depending on actuation of the solenoid.

3. A pin arrangement control apparatus, comprising:

scissors for pinching a neck portion of a bowling pin;

a link mechanism for performing an opening/closing operation of the scissors; and a connecting unit provided between the scissors and the link mechanism, including a solenoid which is set to an actuation state of conducting or non-conducting, and a lock mechanism for setting the scissors and the link mechanism into a linked state or a free state therebetween in response to the actuation state of the solenoid, wherein in said linked state, said connecting unit transfers motion of said link mechanism to said scissors, causing said scissors to open or close, the link mechanism further includes a pin, and the lock mechanism comprises:

a slide plate including an elongate hole in which the pin resides;

a transform mechanism connected to said slide plate for transforming a straight motion into a rotational motion and then further transferring the rotational motion to the scissors; and a pin coupling plate connected to said slide plate for engaging the pin into a coupled state or a non-coupled state with the lock mechanism depending upon actuation of the solenoid.

4. A connecting unit for pin arrangement control in bowling, said connecting unit provided between scissors for pinching a neck portion of a bowling pin and a link mechanism for performing an opening/closing operation of the scissors, the link mechanism including a rod with a circumferential groove configured to receive a plurality of balls, said connecting unit including:

a solenoid which is set to an actuation state of conducting or non-conducting; and a lock mechanism for setting the scissors and the link mechanism into a linked state or a free state therebetween in response to the actuation state of the solenoid, the lock mechanism comprising:

a pipe which is slidably disposed about said rod and said groove, said pipe being further attached to the scissors; and a plurality of balls held by the pipe, wherein the pipe and the rod are put into a latched state or a non-latched state by making the balls fitted or non-fitted to the groove depending on the actuation state of the solenoid, and in said linked state, said connecting unit transfers motion of said link mechanism to said scissors, causing said scissors to open or close.

5. The connecting unit for pin arrangement control in bowling, said connecting unit provided between scissors for pinching a neck portion of a bowling pin and a link mechanism for performing an opening/closing operation of the scissors, comprising:

a solenoid which is set to an actuation state of conducting or non-conducting; and a lock mechanism for setting the scissors and the link mechanism into a linked state or a free state therebetween in response to the actuation state of the solenoidthe solenoid includes an actuation portion whose position is dependent upon the actuation state of the solenoid, wherein in said linked state, said connecting unit tranfers motion of said link mechanism to said scissors, causing said scissors to open or close, the lock mechanism includes a slide member which is attached to the link mechanism and which is engaged in a slide-locked state when in contact with the actuation portion of the solenoid, and is engaged in a free-slide state when not contacted by the actuation portion of the solenoid, and the scissors and the link mechanism are put into a linked state or a free state therebetween by putting the slide member into a free-slide state or the slide-locked state depending on actuation of the solenoid.

6. A connecting unit for pin arrangement control in bowling, said connecting unit provided between scissors for pinching a neck portion of a bowling pin and a link mechanism for performing an opening/closing operation of the scissors, comprising:

a solenoid which is set to an actuation state of conducting or non-conducting; and a lock mechanism for setting the scissors and the link mechanism into a linked state or a free state therebetween in response to the actuation state of the solenoidthe solenoid includes an actuation portion whose portion is dependent upon the actuation state of the solenoid, wherein in said linked state, said connecting unit transfers motion of said link mechanism to said scissors, causing said scissors to open or close, the link mechanism further includes a pin, and the lock mechanism comprises:

a slide plate including an elongate hole in which the pin resides;

a transform mechanism connected to said slide plate for transforming a straight motion into a rotational motion and then further transferring the rotational motion to the scissors; and a pin coupling plate connected to said slide plate for engaging the pin into a coupled state or a non-coupled state with the lock mechanism depending upon actuation state of the solenoid.

* * * * *